US012781588B1

(12) United States Patent
Anton et al.

(10) Patent No.: US 12,781,588 B1
(45) Date of Patent: Nov. 3, 2026

(54) FRAC PLUG SETTABLE BY FLUID PRESSURE

(71) Applicant: Lonestar Completion Tools, LLC, Tomball, TX (US)

(72) Inventors: Kenneth J. Anton, Brenham, TX (US); Michael J. Harris, Houston, TX (US)

(73) Assignee: Lonestar Completion Tools, LLC, Tomball, TX (US)

( * ) Notice: Subject to any disclaimer, the term of this patent is extended or adjusted under 35 U.S.C. 154(b) by 0 days.

(21) Appl. No.: 18/946,751

(22) Filed: Nov. 13, 2024

Related U.S. Application Data

(60) Provisional application No. 63/548,521, filed on Nov. 14, 2023.

(51) Int. Cl.
*E21B 33/1295* (2006.01)
*E21B 33/128* (2006.01)

(52) U.S. Cl.
CPC ..... *E21B 33/1285* (2013.01)

(58) Field of Classification Search
CPC ..... E21B 33/1285; E21B 33/1295
USPC ..... 166/387, 384
See application file for complete search history.

(56) References Cited

U.S. PATENT DOCUMENTS 2,114,373 A * 4/1938 Edwards ..... E21B 33/12955 166/135
3,109,493 A 11/1963 Carter
3,602,305 A 8/1971 Kisling, III
3,948,321 A * 4/1976 Owen ..... E21B 23/0414 166/207
4,901,794 A 2/1990 Baugh et al.
5,058,672 A 10/1991 Cochran
5,058,684 A 10/1991 Winslow et al.
5,271,468 A 12/1993 Streich et al.
5,511,620 A 4/1996 Baugh et al.
5,984,007 A 11/1999 Yuan et al.
6,220,349 B1 4/2001 Vargus et al.
6,394,180 B1 5/2002 Berscheidt et al.
6,491,116 B2 12/2002 Berscheidt et al.
7,306,044 B2 * 12/2007 Connell ..... E21B 29/10 166/207

(Continued)

FOREIGN PATENT DOCUMENTS

EP 1712729 A2 10/2006
WO 2015/171126 A1 11/2015

OTHER PUBLICATIONS

American Completion Tools, *Hydraulic Setting Tool* p. 19 (undated).

(Continued)

*Primary Examiner* — Kenneth L Thompson
(74) *Attorney, Agent, or Firm* — Keith B. Willhelm

(57) ABSTRACT

A frac plug is adapted for setting in a well liner by fluid pressure. The frac plug comprises a radially expandable body and a cone. The radially expandable body has an axial bore providing the expandable body with a tapered inner surface. The cone occludes the axial bore of the expandable body. It has a tapered outer surface engaging the tapered inner surface of the radially expandable body. The cone is adapted, in response to fluid pressure above the cone, to be displaced axially within the radially expandable body from an unset position to a set position, thereby expanding the expandable body and setting the frac plug in the liner.

33 Claims, 8 Drawing Sheets

(56) References Cited

U.S. PATENT DOCUMENTS

| | | | | |
|---|---|---|---|---|
| 7,475,736 | B2 | 1/2009 | Lehr et al. | |
| 7,600,572 | B2 | 10/2009 | Slup et al. | |
| 7,730,941 | B2 * | 6/2010 | Abarca | E21B 33/1208 166/207 |
| 7,740,079 | B2 | 6/2010 | Clayton et al. | |
| 7,743,836 | B2 * | 6/2010 | Cook | E21B 33/129 166/134 |
| 7,789,137 | B2 | 9/2010 | Turley et al. | |
| 7,878,240 | B2 * | 2/2011 | Garcia | E21B 43/105 166/207 |
| 8,047,280 | B2 | 11/2011 | Tran et al. | |
| 8,066,065 | B2 | 11/2011 | Buckner | |
| 8,336,616 | B1 | 12/2012 | McClinton | |
| 8,469,088 | B2 | 6/2013 | Shkurti et al. | |
| 8,579,024 | B2 | 11/2013 | Mailand et al. | |
| 8,887,818 | B1 | 11/2014 | Carr et al. | |
| 8,950,504 | B2 | 2/2015 | Xu et al. | |
| 8,955,605 | B2 | 2/2015 | VanLue | |
| 8,985,228 | B2 | 3/2015 | Xu et al. | |
| 8,997,853 | B2 | 4/2015 | VanLue | |
| 9,010,411 | B1 | 4/2015 | VanLue | |
| 9,010,416 | B2 | 4/2015 | Xu et al. | |
| 9,033,060 | B2 | 5/2015 | Xu et al. | |
| 9,074,439 | B2 | 7/2015 | VanLue | |
| 9,080,403 | B2 | 7/2015 | Xu et al. | |
| 9,080,416 | B2 | 7/2015 | Xu et al. | |
| 9,080,439 | B2 | 7/2015 | O'Malley et al. | |
| 9,097,095 | B2 | 8/2015 | VanLue | |
| 9,103,177 | B2 | 8/2015 | VanLue | |
| 9,121,247 | B2 | 9/2015 | George et al. | |
| 9,121,252 | B2 | 9/2015 | George et al. | |
| 9,273,526 | B2 | 3/2016 | Oberg et al. | |
| 9,284,803 | B2 | 3/2016 | Stone et al. | |
| 9,309,733 | B2 | 4/2016 | Xu et al. | |
| 9,316,086 | B2 | 4/2016 | VanLue | |
| 9,359,863 | B2 | 6/2016 | Streich et al. | |
| 9,574,415 | B2 | 2/2017 | Xu et al. | |
| 9,816,339 | B2 * | 11/2017 | Xu | E21B 29/02 |
| 9,835,003 | B2 | 12/2017 | Harris et al. | |
| 10,000,991 | B2 | 6/2018 | Harris et al. | |
| 10,107,072 | B2 | 10/2018 | Harris et al. | |
| 10,352,125 | B2 | 7/2019 | Frazier | |
| 10,808,480 | B2 * | 10/2020 | Hern | E21B 33/134 |
| 11,002,104 | B2 | 5/2021 | Wolf et al. | |
| 11,131,162 | B2 * | 9/2021 | Hern | E21B 33/128 |
| 11,236,567 | B2 | 2/2022 | Hardesty | |
| 11,434,715 | B2 * | 9/2022 | Harris | E21B 33/1265 |
| 11,821,281 | B2 * | 11/2023 | Swor | E21B 33/13 |
| 12,392,213 | B2 * | 8/2025 | Wilkinson | E21B 33/1291 |
| 2002/0121379 | A1 | 9/2002 | Doane | |
| 2008/0191420 | A1 | 8/2008 | Imhoff et al. | |
| 2010/0181761 | A1 | 7/2010 | Santi et al. | |
| 2010/0276159 | A1 | 11/2010 | Mailand et al. | |
| 2011/0088891 | A1 | 4/2011 | Stout | |
| 2011/0259610 | A1 | 10/2011 | Shkurti et al. | |
| 2013/0186649 | A1 | 7/2013 | Xu et al. | |
| 2013/0240201 | A1 | 9/2013 | Frazier | |
| 2014/0209325 | A1 | 7/2014 | Dockweiler et al. | |
| 2014/0227024 | A1 | 8/2014 | Gilling | |
| 2014/0262214 | A1 | 9/2014 | Mhaskar et al. | |
| 2015/0068729 | A1 | 3/2015 | Carr et al. | |
| 2015/0129239 | A1 | 5/2015 | Richard | |
| 2015/0300121 | A1 | 10/2015 | Xu | |
| 2016/0145964 | A1 | 5/2016 | Doane et al. | |
| 2016/0186511 | A1 | 6/2016 | Coronado et al. | |
| 2017/0101835 | A1 | 4/2017 | Webster et al. | |
| 2018/0087347 | A1 | 3/2018 | Rochen et al. | |
| 2020/0056445 | A1 | 2/2020 | Hardesty | |
| 2021/0270099 | A1 | 9/2021 | Mhaskar et al. | |

OTHER PUBLICATIONS

American Completion Tools, *Model Fury 05 Hydraulic Setting Tool Operation Procedure* pp. 50-52 (undated).
Baker Hughes Inc., *Torpedo Composite Frac Plug—Overview* (Copyright 2017).
Baker Hughes, *E-4 Wireline Pressure Setting Assembly and Baker Hughes C Firing Heads* (© 2012-2014).
Baker Hughes, *Model E-4™ Wireline Pressure Setting Assemblies* (© 2014).
Baker Hughes, *SHADOW Series Frac Plug* (© 2014).
Downhole Technology LLC, *Boss Hog Features at a Glance*, www.downholetechnology.com/features-benefits/boss-hog-at-a-glance (Jun. 5, 2017).
Evonik Industries, *CAMPUS® Datasheet—VESTKEEP® L 4000 G-PEEK* (Aug. 25, 2016).
Evonik Industries, *Product Information—VESTAKEEP® L4000G High-Viscosity, Unreinforced Polyether Ether Ketone* (Oct. 2011).
Evonik Industries, *VESTAKEEP® PEEK—Polyether Ether Ketone Compounds* (undated).
Evonik Industries, *VESTAKEEP® PEEK Offers the Strongest Bonding Strength to Withstand Strict Operating Environmental Conditions* (Oct. 27, 2014).
Geodynamics, *FracDock™ Intervention-free Frac Plug System—Frac It and Forget It* (© 2015).
Geodynamics, *SmartStart PLUS™*(undated).
Halliburton, *Fas Drill® Bridge Plug* (© 2014).
Halliburton, *Halliburton 250-Series Frac Plugs* (© 2012).
Halliburton, *Obsidian® Frac Plug* (Copyright 2015).
Halliburton, *Wireline Setting Tools* (© 2015).
High Pressure Integrity, Inc., *Direct Pump Setting Tool DPST—Chapter 6* (© 2008 Weatherford).
Magnum Oil Tools Int'l, *Composite Frac Plugs—Magnum Series* (May 16, 2017).
Nine Energy Service, *Scorpion High-Quality, Fully Composite Plugs* (undated).
Owen Oil Tool, *Big Bore Frac Plug* (© 2002).
Peak Completions, *Set-a-Seat™ Pump-Down Casing Baffle* (© 2014-15).
Schlumberger, *Copperhead Big Bore Flow-Through Frac Plug* (© 2014).
Schlumberger, *Diamondback Composite Drillable Frac Plug* (© 2016).
Schlumberger, *Model E Hydraulic Setting Tool* (© 2014).
Superior Energy Services, *OmniFrac™ Systems* (undated).
Tam International, *PosiFrac HALO™—Large Bore Fracture Seat* (2016).
Unknown, *Baker Style # 20 Setting Tool* (undated).
Weatherford, *TruFrac® Composite Frac Plug—Optimizing Costs in Plug-and-Perf Operations* (undated).
Weatherford, *TruFrac® Composite Frac Plug* (© 2015).
Weatherford, *TruFrac® Composite Frac Plug* (undated).

* cited by examiner

FRAC PLUG SETTABLE BY FLUID PRESSURE

FIELD OF THE INVENTION

The present invention relates generally to plugs that may be used to isolate a portion of a well, and more particularly, to plugs that may be used in fracturing and other processes for stimulating oil and gas wells.

BACKGROUND OF THE INVENTION

Hydrocarbons, such as oil and gas, may be recovered from various types of subsurface geological formations. The formations typically consist of a porous layer, such as limestone and sands, overlaid by a nonporous layer. Hydrocarbons cannot rise through the nonporous layer. Thus, the porous layer forms a reservoir, that is, a volume in which hydrocarbons accumulate. A well is drilled through the earth until the hydrocarbon bearing formation is reached. Hydrocarbons then can flow from the porous formation into the well.

In what is perhaps the most basic form of rotary drilling methods, a drill bit is attached to a series of pipe sections or "joints" referred to as a drill string. The drill string is suspended from a derrick and rotated by a motor in the derrick. A drilling fluid or "mud" is pumped down the drill string, through the bit, and into the bore of the well. This fluid serves to lubricate the bit. The drilling mud also carries cuttings from the drilling process back to the surface as it travels up the wellbore. As the drilling progresses downward, the drill string is extended by adding more joints of pipe.

When the drill bit has reached the desired depth, larger diameter pipes, or casing, are placed in the well and cemented in place to prevent the sides of the borehole from caving in. The well may be extended by drilling additional sections and installing large, but somewhat smaller pipes, or liners. The liners also are typically cemented in the bore. The liner may include valves, or it may then be perforated. In either event, openings in the liner are created through which oil can enter the cased well. Production tubing, valves, and other equipment are installed in the well so that the hydrocarbons may flow in a controlled manner from the formation, into the lined well bore, and through the production tubing up to the surface for storage or transport.

Hydrocarbons, however, are not always able to flow easily from a formation to a well. Some subsurface formations, such as sandstone, are very porous. Hydrocarbons can flow easily from the formation into a well. Other formations, however, such as shale rock, limestone, and coal beds, are only minimally porous. The formation may contain large quantities of hydrocarbons, but production through a conventional well may not be commercially practical because hydrocarbons flow though the formation and collect in the well at very low rates. The industry, therefore, relies on various techniques for improving the well and stimulating production from formations that are relatively nonporous.

Perhaps the most important stimulation technique is the combination of horizontal wellbores and hydraulic fracturing. A well will be drilled vertically until it approaches a formation. It then will be diverted, and drilled in a more or less horizontal direction, so that the borehole extends along the formation instead of passing through it. More of the formation is exposed to the borehole, and the average distance hydrocarbons must flow to reach the well is decreased. Fractures then are created in the formation that will allow hydrocarbons to flow more easily from the formation.

Fracturing a formation is accomplished by pumping fluid, most commonly water, into the well at high pressure and flow rates. Proppants, such as grains of sand, ceramic or other particulates, usually are added to the fluid along with gelling agents to create a slurry. The slurry is forced into the formation at rates faster than can be accepted by the existing pores, fractures, faults, vugs, caverns, or other spaces within the formation. Pressure builds rapidly to the point where the formation fails and begins to fracture. Continued pumping of fluid into the formation will tend to cause the initial fractures to widen and extend further away from the wellbore, creating flow paths to the well. The proppant serves to prevent fractures from closing when pumping is stopped.

Fracturing typically involves installing a production liner in the portion of the wellbore passing through the hydrocarbon bearing formation. The production liner may incorporate valves, typically sliding sleeve "ball-drop" valves, to divert fluid into the formation. More commonly, however, the production liner does not incorporate valves. Instead, fracturing will be accomplished by "plugging and perfing" the liner.

In a "plug and perf" job, the production liner is made up from standard joints of liner. The liner does not have any openings through its sidewalls, nor does it incorporate frac valves. It is installed in the wellbore, and holes then are punched in the liner walls. The perforations typically are created by so-called "perf" guns that discharge shaped charges through the liner and, if present, adjacent cement. Fluids can be flowed through the perforations into the formation.

A well rarely, if ever, is fractured all at once. It typically will be fractured in many different locations or "zones" and in many different stages. Typically, the first zone will be at the bottom or "toe" of the well, and fluid will be injected through a toe valve. The toe valve is opened to initiate fracturing. Fluids then are pumped into the well to fracture the formation in the vicinity of the toe valve.

After the initial zone is fractured, pumping is stopped. A plug is installed in the liner at a point above the fractured zone. The liner is perforated in a second zone located above the plug. With typical conventional frac plugs, a ball then is deployed onto the plug. The ball will restrict fluids from flowing through and past the plug. When fluids are injected into the liner, therefore, they will be forced to flow out the perforations and into the second zone. After the second zone is fractured, the process of plugging, perforating, and injecting is repeated until all zones—typically 50 to a hundred or more—in the well are fractured.

After the well has been fractured, however, plugs may interfere with installation of production equipment in the liner. They also may restrict the flow of production fluids upward through the liner. Thus, the plugs typically are removed from the liner after the well has been fractured. Retrievable plugs are designed to be set and then unset. Once unset, they may be removed from the well. Non-retrievable plugs cannot be "unset," and must be removed to open up the liner.

Most commonly, non-retrievable plugs will be drilled out. Thus, some or all of the components of many conventional non-retrievable frac plugs now are fabricated from more easily drillable materials. Such materials include cast iron, aluminum, and other more brittle or softer metals. Other, more easily drillable materials include fiberglass, carbon fiber materials, and other composite materials. Composite materials are more easily drilled and, therefore, can make it easier to drill out a plug. They also can allow for less aggressive drilling and reduce the likelihood and extent of damage to the liner during drilling. Increasingly, however, plugs are being fabricated from dissolvable metals and other materials that allow the plug to disintegrate over time upon exposure to well fluids.

Whether retrievable or non-retrievable, however, conventional frac plugs are installed by applying a mechanical, compressive force along the axis of the plug to drive a wedge, also referred to as a cone, into an expandable slip element. As the wedge is mechanically driven into the slip element by the compressive, mechanical force, the slip expands radially and grips the liner walls. A ball then is deployed onto a seat in the plug to substantially isolate the portions of the liner below the plug. The ball will restrict fluid from flowing downward through the plug.

Setting tools are used to generate the compressive, mechanical force required to set conventional frac plugs. There are various designs available commercially. Pyrotechnic setting tools, as exemplified by the Baker E4 setting tool available from Baker Hughes Company and GoSet setting tool from Core Laboratories, dba Owen Oil Tools, are one type of setting tool commonly used to set frac plugs. Pyrotechnic setting tools comprise a wireline firing head, also referred to as an ignitor, a combustible power charge, and a piston. The body of the setting tool is mechanically coupled via push-drive components to the upper end of the plug while the piston is mechanically coupled to the lower end via pull-drive components, either directly or through an adaptor. When the plug is positioned in the well liner, a signal is sent through the wireline to the ignitor. The ignitor ignites the power charge. As the power charge burns, it generates gas and creates fluid pressure above the piston, driving the piston downward. The setting tool thus converts fluid pressure into a compressive, mechanical force above and below the plug that ultimately squeezes the cone and slip of the plug toward each other.

In summary, frac plugs must be capable of being run into and installed in the liner in a reliable and predictable manner. When installed, they must be anchored securely and provide an effective and robust seal so that the plug is capable of diverting frac fluids pumped into the liner at high-pressures and flow rates. They also must be removed quickly, cheaply, and effectively once well operations are completed and they are no longer needed. At the same time, because a well may be fractured in many different zones and require many plugs, it is important that the plugs can be fabricated economically and with precision.

The statements in this section are intended to provide background information related to the invention disclosed herein. Such information may or may not constitute prior art. It will be appreciated from the foregoing, however, that there remains a need for new and improved frac plugs and isolation plugs that can be used in other well stimulation processes. Such disadvantages and others inherent in the prior art are addressed by various aspects and embodiments of the subject invention.

SUMMARY OF THE INVENTION

The subject invention, in its various aspects and embodiments, relates generally to plugs that may be used to isolate a portion of a well and encompasses various embodiments and aspects, some of which are specifically described and illustrated herein. One broad embodiment provides for a frac plug adapted for setting in a well liner. The frac plug comprises a radially expandable slip and a cone. The slip has an axial bore that provides the slip with a tapered inner surface. The tapered inner surface decreases in diameter from the upper extent of the tapered inner surface toward the lower extent of the tapered inner surface. The cone occludes the axial bore of the expandable slip and is adapted to radially expand the expandable slip. The cone has a tapered outer surface engaging the slip tapered inner surface. The cone tapered outer surface decreases in diameter from the upper extent of the tapered outer surface toward the lower extent of the tapered outer surface. The cone tapered outer surface and the slip tapered inner surface have complimentary angles. The cone is adapted for displacement from an unset position in an upper portion of the slip tapered inner surface to a set position in a lower portion of the slip tapered inner surface. The cone, in response to fluid pressure above the cone, moves from the unset position to the set position and thereby expands the slip radially.

Other embodiments provide such frac plugs where the slip tapered inner surface is a generally inverted truncated conical surface and the cone tapered outer surface is a generally inverted truncated conical surface.

Yet other embodiments provide such frac plugs where the tapered outer surface of the cone and the tapered inner surface of the slip are provided with a taper from about 10° to about 30° off center.

Additional embodiments provide such frac plugs where the tapered outer surface of the cone and the tapered inner surface of the slip provide a self-locking taper fit between the cone and the slip.

Still other embodiments provide such frac plugs where the body of the cone is a truncated inverted solid cone.

Further embodiments provide such frac plugs where the frac plug comprises a pressure seal carried between the cone and the axial bore of the expandable slip.

Other embodiments provide such frac plugs where the frac plug comprises a radially expandable sealing ring around an outer circumference of the slip.

Yet other embodiments provide such frac plugs where the sealing ring is an elastomeric sealing ring.

Additional embodiments provide such frac plugs where the sealing ring is fabricated from a plastically deformable plastic.

Still other embodiments provide such frac plugs where the sealing ring is fabricated from plastically deformable plastics selected from the group consisting of polycarbonates, polyamides, polyether ether ketones, and polyetherimides and copolymers and mixtures thereof.

Further embodiments provide such frac plugs where the slip comprises a non-expandable portion and an expandable portion joined by a relatively weak bridging portion adapted to break in a controlled manner, the separable non-expandable portion and expandable portion thereby forming an integral component comprising the non-expandable portion and the expandable portion.

Other embodiments provide such frac plugs where the cone, when the plug is in its unset state, is carried within the expandable portion of the slip.

Yet other embodiments provide such frac plugs where the slip comprises a gauge portion joined to the expandable portion by a relatively weak bridging portion adapted to break in a controlled manner, the separable non-expandable portion, the expandable portion, and the gauge portion thereby forming an integral component comprising the non-expandable portion, the expandable portion, and the gauge portion.

Additional embodiments provide such frac plugs where the outer surface of the slip is provided with means for enhancing engagement and gripping of a liner wall.

Still other embodiments provide such frac plugs where the gripping means are ceramic, heat-treated steel, sintered powder metal, or carbide buttons.

Further embodiments provide such frac plugs where the slip and the cone are fabricated from a dissolvable metal.

Other embodiments provide such frac plugs where the slip and the cone are fabricated from a wound-fiber resin blank.

In other aspects and embodiments, the subject invention provides for oil and gas wells. The well comprises a liner. The novel frac plug has been installed by driving the cone into the slip by fluid pressure applied to an upper surface of the cone.

In yet other aspects and embodiments, the subject invention provides for a tool assembly for occluding a well liner. The tool assembly comprises a frac plug and a fluid pressure generator. The frac plug is adapted for setting in the liner and comprises a radially expandable slip and a cone. The slip has an axial bore that provides the slip with a tapered inner surface. The tapered inner surface decreases in diameter from the upper extent of the tapered inner surface toward the lower extent of the tapered inner surface. The cone occludes the axial bore of the expandable slip and is adapted to radially expand the expandable slip. The cone has a tapered outer surface engaging the slip tapered inner surface. The cone tapered outer surface decreases in diameter from the upper extent of the tapered outer surface toward the lower extent of the tapered outer surface. The cone tapered outer surface and the slip tapered inner surface have complimentary angles. The cone is adapted for displacement from an unset position in an upper portion of the slip tapered inner surface to a set position in a lower portion of the slip tapered inner surface. The fluid pressure generator is coupled to the slip and is in fluid communication with an upper surface of the cone. The cone, in response to fluid pressure generated by the fluid pressure generator, moves from the unset position to the set position and thereby expands the slip radially into engagement with the liner.

Other embodiments provide such tool assemblies where the fluid pressure generator generates gas pressure.

Yet other embodiments provide such tool assemblies where the fluid pressure generator comprises a generally cylindrical pressure chamber sub assembled to an upper portion of the slip.

Additional embodiments provide such tool assemblies where the pressure chamber sub is integral with the expandable slip.

Still other embodiments provide such tool assemblies where the fluid pressure generator comprises a combustible power charge carried within the pressure chamber sub and adapted to generate gas pressure therein.

Further embodiments provide such tool assemblies where the assembly comprises an ignitor operatively coupled to the combustible power charge.

Other embodiments provide such tool assemblies where the slip comprises a non-expandable portion and an expandable portion joined by a relatively weak bridging portion adapted to break in a controlled manner, the separable non-expandable portion and expandable portion thereby forming an integral component comprising the non-expandable portion and the expandable portion.

Yet other embodiments provide such tool assemblies where the fluid pressure generator comprises a generally cylindrical pressure chamber sub assembled to the non-expandable portion of the slip.

Additional embodiments provide such tool assemblies where the plug, when the plug is in its unset state, is carried within the expandable portion.

Still other embodiments provide such tool assemblies where the frac plug comprises a pressure seal between the pressure chamber sub and the slip.

In other aspects and embodiments, the subject invention provides methods of setting a plug in a well liner to isolate a downhole portion of the liner. The method comprises running a tool assembly comprising the plug into the liner to a location to be occluded. The plug is in an unset state and comprises a radially expandable slip and a cone. The slip has an inwardly tapered axial bore. The cone occludes the slip axial bore and has an inwardly tapered outer circumference. The method further comprises applying fluid pressure to an upper surface of the cone to drive the cone downward into the slip and thereby expand the slip radially into engagement with the liner and anchor the plug in the liner.

Other embodiments provide such methods where the fluid pressure is gas pressure.

Yet other embodiments provide such methods where the plug comprises a radially expandable sealing ring mounted around an outer circumference of the slip. The sealing ring is expanded radially into engagement with the liner as the slip is expanded radially to provide a seal between the plug and the liner.

Additional embodiments provide such methods where the tool assembly comprises a fluid pressure generator comprising a generally open cylindrical sub assembled to the slip. The sub provides a pressure chamber communicating with an upper surface of the cone. The slip comprises a non-expandable portion and an expandable portion joined by a relatively weak bridging portion adapted to break in a controlled manner. The separable non-expandable portion and expandable portion thereby forms an integral component comprising the non-expandable portion and the expandable portion. The method comprises applying fluid pressure to break the bridging portion and separate the non-expandable portion of the slip from the expandable portion of the slip after the slip has been expanded radially into engagement with the liner.

Still other embodiments provide such methods where the tool assembly comprises a combustible power charge carried within the pressure chamber and an ignitor operatively coupled to the combustible power charge. The method comprises actuating the ignitor to ignite the combustible power charge. The combustible power charge thereby provides the fluid pressure to drive the cone into the slip to set the plug.

Further embodiments provide such methods where the method comprises withdrawing the pressure chamber sub from the liner after the bridging portion between the non-expandable portion of the slip and the expandable portion of the slip has been broken.

In other aspects and embodiments, the subject invention provides for a frac plug adapted for setting in a well liner. The frac plug comprises a radially expandable body and a cone. The radially expandable body has an axial bore that provides the expandable body with a tapered inner surface. The tapered inner surface decreases in diameter from the upper extent of the tapered inner surface toward the lower extent of the tapered inner surface. The cone occludes the axial bore of the expandable body and is adapted to radially expand the expandable body. It has a tapered outer surface engaging the expandable body tapered inner surface. The tapered outer surface of the cone decreases in diameter from the upper extent of the tapered outer surface toward the lower extent of the tapered outer surface. The cone tapered outer surface and the slip tapered inner surface have complimentary angles.

The cone is adapted for displacement axially in response to fluid pressure above the cone from an unset position in an upper portion of the expandable body tapered inner surface to a set position in a lower portion of the expandable body tapered inner surface. Thus, the cone, in response to fluid pressure above the cone, is displaced axially from the unset position to the set position, thereby radially expanding the expandable body.

Other embodiments provide such frac plugs where the expandable body comprises an upper, non-expanded portion and a lower, expandable portion and the tapered inner a surface of the expandable body is provided in the expandable portion.

Yet other embodiments provide such frac plugs where the expandable body tapered inner surface is a generally inverted truncated conical surface and the cone tapered outer surface is a generally inverted truncated conical surface.

Additional embodiments provide such frac plugs where the tapered outer surface of the cone and the tapered inner surface of the expandable body are provided with a taper from about 5° to about 30° off center or from about 10° to about 30° off center.

Still other embodiments provide such frac plugs where the tapered outer surface of the cone and the tapered inner surface of the expandable body provide a self-locking taper fit between the cone and the expandable body.

Further embodiments provide such frac plugs where the frac plug comprises a pressure seal carried between the cone and the axial bore of the expandable body.

Other embodiments provide such frac plugs where the frac plug comprises a radially expandable sealing ring around an outer circumference of the expandable body.

Yet other embodiments provide such frac plugs where the sealing ring is an elastomeric sealing ring, is fabricated from a plastically deformable plastic, is fabricated from plastically deformable plastics selected from the group consisting of polycarbonates, polyamides, polyether ether ketones, and polyetherimides and copolymers and mixtures thereof, or is fabricated from a dissolvable metal.

Additional embodiments provide such frac plugs where the expandable body and the cone are fabricated from a dissolvable metal or are fabricated from a wound-fiber resin blank.

Still other embodiments provide such frac plugs where the cone comprises a wedge and a stopper. The wedge provides the cone with the tapered outer surface and has an axial bore. The stopper occludes the axial bore of the wedge whereby the cone occludes the axial bore of the expandable body.

Further embodiments provide such frac plugs where, when the frac plug is in its the unset state, the cone is mounted in the expandable body such that an upper portion of the tapered outer surface on the wedge of the cone engages the tapered inner surface of an expandable portion of the expandable body.

Other embodiments provide such frac plugs where the frac plug comprises an annular array of slips having tapered inner surfaces. The slips are mounted around and on a lower portion of the tapered outer surface of the wedge of the cone. The slip tapered inner surfaces and the wedge tapered outer surface have complementary angles. The slips are adapted to be shifted radially outward into engagement with the liner as the cone is displaced axially from its the unset position to its the set position.

Yet other embodiments provide such frac plugs where the frac plug comprises an elastomer seal and an array of slips. The elastomer seal is mounted around the expandable portion of the expandable body. The slips have tapered inner surfaces and are mounted around and on a lower portion of the tapered outer surface of the wedge of the cone. A lower end of the expandable portion of the expandable body engages an upper end of the array of slips.

Additional embodiments provide such frac plugs where the outer surface of the slips are provided with means for enhancing engagement and gripping of a liner wall, such as ceramic, heat-treated steel, sintered powder metal, or carbide buttons.

Still other embodiments provide such frac plugs where the frac plug comprises a gage ring coupled to a lower end of the cone. A lower end of the array of slips abuts the gage ring.

Further embodiments provide such frac plugs where the stopper, when the frac plug is set in the liner, is adapted to be displaced from the wedge by fluid pressure below the frac plug and thereby allow fluid flow upward through the frac plug.

Other embodiments provide such frac plugs where, after the stopper is displaced upward from the wedge, the frac plug comprises means for guiding the stopper back into the wedge, thereby shutting off fluid flow downward through the frac plug.

Yet other embodiments provide such frac plugs where the frac plug comprises a traveler and a connecting rod. The traveler is mounted for movement though a pair of opposing, axially extending lateral slots is the wedge. The connecting rod extends between the stopper and the traveler.

Additional embodiments provide such frac plugs where the frac plug comprises a ball and ball seat. The ball seat is provided in the axial bore of the wedge below the stopper. The ball is captured between the stopper and the ball seat.

Still other embodiments provide such frac plugs where the gage ring is fabricated from a dissolvable metal and comprises at least one dissolution passage and where the dissolution passage is a through passage or a bottomed hole.

Further embodiments provide such frac plugs where the slips are fabricated from a dissolvable metal and comprises at least one dissolution passage or where the cone is fabricated from a dissolvable metal and comprises at least one dissolution passage.

Other embodiments provide such frac plugs where the cone is a stopper occluding the axial bore of the expandable body and where the stopper is a truncated inverted solid cone.

Yet other embodiments provide such frac plugs where an expandable portion of the expandable body provides a radially expandable slip adapted to expand radially into engagement with the liner as the stopper is displaced axially from its the unset position to its the set position.

Additional embodiments provide such frac plugs where the outer surface of the slip is provided with means for enhancing engagement and gripping of a liner wall, such as ceramic, heat-treated steel, sintered powder metal, or carbide buttons.

Still other embodiments provide such frac plugs where a non-expanded portion and a expandable portion of the expandable body are joined by a relatively weak bridging portion adapted to break in a controlled manner. The separable non-expanded portion and expandable portion thereby form an integral component comprising the non-expanded portion and the expandable portion.

Further embodiments provide such frac plugs where the expandable body comprises a gauge portion joined to a lower end of the expandable portion by a relatively weak bridging portion adapted to break in a controlled manner. The separable non-expanded portion, the expandable portion, and the gauge portion thereby form an integral component comprising the non-expanded portion, the expandable portion, and the gauge portion.

Other embodiments provide such frac plugs where the frac plug comprises a pressure seal carried between the stopper and the axial bore of an expandable portion of the expandable body.

Yet other embodiments provide such frac plugs where the frac plug comprises a a radially expandable sealing ring mounted around an outer circumference of the expandable portion of the expandable body.

Additional embodiments provide such frac plugs where the sealing ring is an elastomeric sealing ring.

Still other embodiments provide such frac plugs where the cone, when the frac plug is in its unset state, is carried within the expandable portion of the expandable body.

In other aspects and embodiments, the subject invention provided an oil and gas well. The well comprises a liner in which the novel frac plugs have been installed by driving the cone into the expandable body by fluid pressure applied to an upper surface of the cone.

In yet other aspects and embodiments, the subject invention provides a tool assembly for occluding a well liner. The tool assembly comprises a frac plug and a fluid pressure generator. The frac plug is adapted for setting in the liner by fluid pressure and comprises a radially expandable body and a cone. The radially expandable body has an axial bore. The bore provides the expandable body with a tapered inner surface. The tapered inner surface decreases in diameter from the upper extent of the tapered inner surface toward the lower extent of the tapered inner surface. The cone occludes the axial bore of the expandable body and is adapted to radially expand the expandable body. The cone has a tapered outer surface engaging the expandable body tapered inner surface. The tapered outer surface of the cone decreases in diameter from the upper extent of the tapered outer surface toward the lower extent of the tapered outer surface. The cone tapered outer surface and the slip tapered inner surface have complimentary angles. The cone is adapted for displacement axially in response to fluid pressure above the cone from an unset position in an upper portion of the expandable body tapered inner surface to a set position in a lower portion of the expandable body tapered inner surface.

The fluid pressure generator is operably coupled to the frac plug and in fluid communication with an upper surface of the cone. The cone, in response to fluid pressure generated by the fluid pressure generator, moves from the unset position to the set position, thereby expanding the slip radially into engagement with the liner.

Other embodiments provide such tool assemblies where the fluid pressure generator generates gas pressure.

Yet other embodiments provide such tool assemblies where the fluid pressure generator comprises a generally cylindrical pressure chamber sub.

Additional embodiments provide such tool assemblies where the fluid pressure generator comprises a combustible power charge carried within the pressure chamber sub that is adapted to generate gas pressure therein.

Still other embodiments provide such tool assemblies where the tool assembly comprises an ignitor operatively coupled to the combustible power charge.

Further embodiments provide such tool assemblies where the pressure chamber sub is integral with the expandable body.

Other embodiments provide such tool assemblies where the expandable body comprises an upper, non-expanded portion and a lower, expandable portion and the tapered inner surface of the expandable body is provided in the expandable portion.

Yet other embodiments provide such tool assemblies where the fluid pressure generator comprises a generally cylindrical pressure chamber sub assembled to the non-expanded portion of the expandable body.

Additional embodiments provide such tool assemblies where the tool assembly comprises a pump-down sleeve.

Still other embodiments provide such tool assemblies where the pump-down sleeve comprises a generally cylindrical body and a plurality of radially extending, annular ribs. The ribs are arrayed laterally along the outer circumference of the generally cylindrical body. They have a generally triangular cross-section providing each the annular rib with a lower annular surface and an upper annular surface. The width of the lower annular surface is greater than the width of the upper annular surface. The radial peak of the annular ribs increases from the uppermost rib to the lowermost rib.

Further embodiments provide such tool assemblies where the pump-down sleeve is coupled to an outer portion of the expandable body and to an outer portion of the fluid pressure generator. At least a lower portion of the fluid pressure generator extends through the cylindrical body of the pump-down sleeve and into the expandable body.

Other embodiments provide such tool assemblies where the pump-down sleeve is a coupled to the expandable body by a tapered, threaded connection.

In still other aspects and embodiments, the subject invention provides a method for setting a plug in a well liner to isolate a downhole portion of the liner. The method comprises running a tool assembly comprising the plug into the liner to a location to be occluded. The plug is in an unset state and comprises a radially expandable body, a cone, and a radially expandable slip. The radially expandable body has an inwardly tapered axial bore. The cone occludes the expandable body axial bore and has an inwardly tapered outer circumference. The method further comprises applying fluid pressure to an upper surface of the cone to drive the cone downward into the expandable body. As the cone is driven downward it radially expands the expandable body and radially expands the slip into engagement with the liner to set the plug in the liner.

Other embodiments provide such methods where the fluid pressure is gas pressure.

Yet other embodiments provide such methods where the plug comprises a radially expandable sealing ring mounted around an outer circumference of the expandable body. The sealing ring is expanded radially into engagement with the liner as the expandable body is expanded radially to provide a seal between the plug and the liner.

Additional embodiments provide such methods where the tool assembly comprises a fluid pressure generator operably coupled to the plug and adapted to provide the fluid pressure.

Still other embodiments provide such methods where the tool assembly comprises a fluid pressure generator, a combustible power charge, and an ignitor. The fluid pressure generator is operably coupled to the plug and provides a pressure chamber communicating with an upper surface of the cone. The combustible power charge is carried within the pressure chamber. The ignitor is operatively coupled to the combustible power charge. The method comprises actuating the ignitor to ignite the combustible power charge. The combustible power charge thereby provides fluid pressure to drive the cone into the expandable body to set the plug.

Further embodiments provide such methods where the method comprises uncoupling the fluid pressure generator from the plug and withdrawing the fluid pressure generator from the liner.

Other embodiments provide such methods where the tool assembly comprises a fluid pressure generator comprising a generally open cylindrical sub providing a pressure chamber communicating with an upper surface of the cone The expandable body comprises a non-expanded portion and an expandable portion. The cylindrical sub of the fluid pressure generator is assembled to the non-expanded portion of the expandable body by a threaded connection. The method comprises applying fluid pressure to strip the threaded connection to separate the non-expanded portion of the expandable body from the expandable portion of the expandable body after the expandable portion of the expandable body has been expanded radially into engagement with the liner.

Yet other embodiments provide such methods where the method comprises withdrawing the pressure chamber sub from the liner after the threaded connection between the non-expanded portion of the expandable body and the expandable portion of expandable body has stripped.

Additional embodiments provide such methods where the tool assembly comprises a fluid pressure generator comprising a generally open cylindrical sub assembled to the expandable body. The sub provides a pressure chamber communicating with an upper surface of the cone. The expandable body comprises a non-expanded portion and an expandable portion joined by a relatively weak bridging portion adapted to break in a controlled manner. The separable non-expanded portion and expandable portion thereby form an integral component comprising the non-expanded portion and the expandable portion. The method comprises applying fluid pressure to break the bridging portion and separate the non-expanded portion of the expandable body from the expandable portion of the expandable body after the expandable portion of the expandable body has been expanded radially into engagement with the liner.

Still other embodiments provide such methods where the method comprises withdrawing the pressure chamber sub from the liner after the bridging portion between the non-expanded portion of the expandable body and the expandable portion of expandable body has been broken.

In other aspects and embodiments, the subject invention provides a method for setting a frac plug in a well liner to isolate a downhole portion of the liner. The method comprises running the frac plug into the liner to a location to be occluded. The frac plug is in an unset state and comprises a radially expandable body having an axial bore. The method also comprises applying fluid pressure within the axial bore to radially expand the expandable body to set the frac plug in the liner.

Other embodiments provide such methods where the expandable body is expanded primarily through the fluid acting directly on the expandable body.

Yet other embodiments provide such methods where the expandable body is expanded primarily by driving a cone to swage the expandable body.

Additional embodiments provide such methods where the frac plug is connected to an uphole tool by a frangible connection, and the method comprises applying the fluid pressure to break the frangible connection after the frac plug is set.

Still other embodiments provide such methods where the expandable body comprises a weak bridging portion joining first and second portions of the plug body. The first expandable body portion is connected to an uphole tool. The fluid pressure breaks the bridging portion after the frac plug is set.

Further embodiments provide such methods where the expandable body is connected to an uphole tool by a threaded connection. The fluid pressure strips the threaded connection after the frac plug is set.

Other embodiments provide such methods where the threaded connection is a tapered threaded connection.

Yet other embodiments provide such methods where the uphole tool is a fluid pressure generator.

Additional embodiments provide such methods where the uphole tool is a pump-down sleeve.

In still other aspects and embodiments, the subject invention provides for a pump-down sleeve that is adapted for assembly above a downhole tool for deployment into a liner. The pump-down sleeve comprises a generally cylindrical body and a plurality of radially extending, annular ribs. The annular ribs are arrayed laterally along the outer circumference of the generally cylindrical body and are adapted to create alternating zones of high fluid pressure and zones of low fluid pressure around the pump-down sleeve as it is deployed into the liner.

Other embodiments provide such pump-down sleeves where fluid pressure in the high pressure zones increases more rapidly that fluid pressure decreases in adjacent the low pressure zones.

Yet other embodiments provide such pump-down sleeves where the peak fluid pressure around each the annular ribs increases from an uppermost the annular rib to a lowermost the annular rib.

Additional embodiments provide such pump-down sleeves where the annular ribs have a generally triangular cross-section providing each annular rib with a lower annular surface and an upper annular surface. The width of the lower annular surface is greater than the width of the upper annular surface. The radial peak of the annular ribs increases from the uppermost rib to the lowermost rib.

Still other embodiments provide such pump-down sleeves where the pump-down sleeve comprises a port extending through the cylindrical body. The port is adapted to allow fluid to flow from the exterior of the cylindrical body to the interior of the cylindrical body.

In yet other aspects and embodiments, the subject invention provides a frac plug adapted for setting in a well liner. The frac plug comprises a plurality of components, at least one of which is fabricated from a dissolvable metal. The component fabricated from a dissolvable metal is provided with a dissolution passage.

Other embodiments provide such frac plugs where the plurality of components comprise one or more of the following components: a slip, a cone, an expandable body, and a gage ring.

Finally, still other aspects and embodiments of the invention provide apparatus and methods having various combinations of such features as will be apparent to workers in the art.

Thus, the present invention in its various aspects and embodiments comprises a combination of features and characteristics that are directed to overcoming various shortcomings of the prior art. The various features and characteristics described above, as well as other features and characteristics, will be readily apparent to those skilled in the art upon reading the following detailed description of the preferred embodiments and by reference to the appended drawings.

Since the description and drawings that follow are directed to particular embodiments, however, they shall not be understood as limiting the scope of the invention. They are included to provide a better understanding of the invention and the manner in which it may be practiced. The subject invention encompasses other embodiments consistent with the disclosure provided herein.

Figure 1:
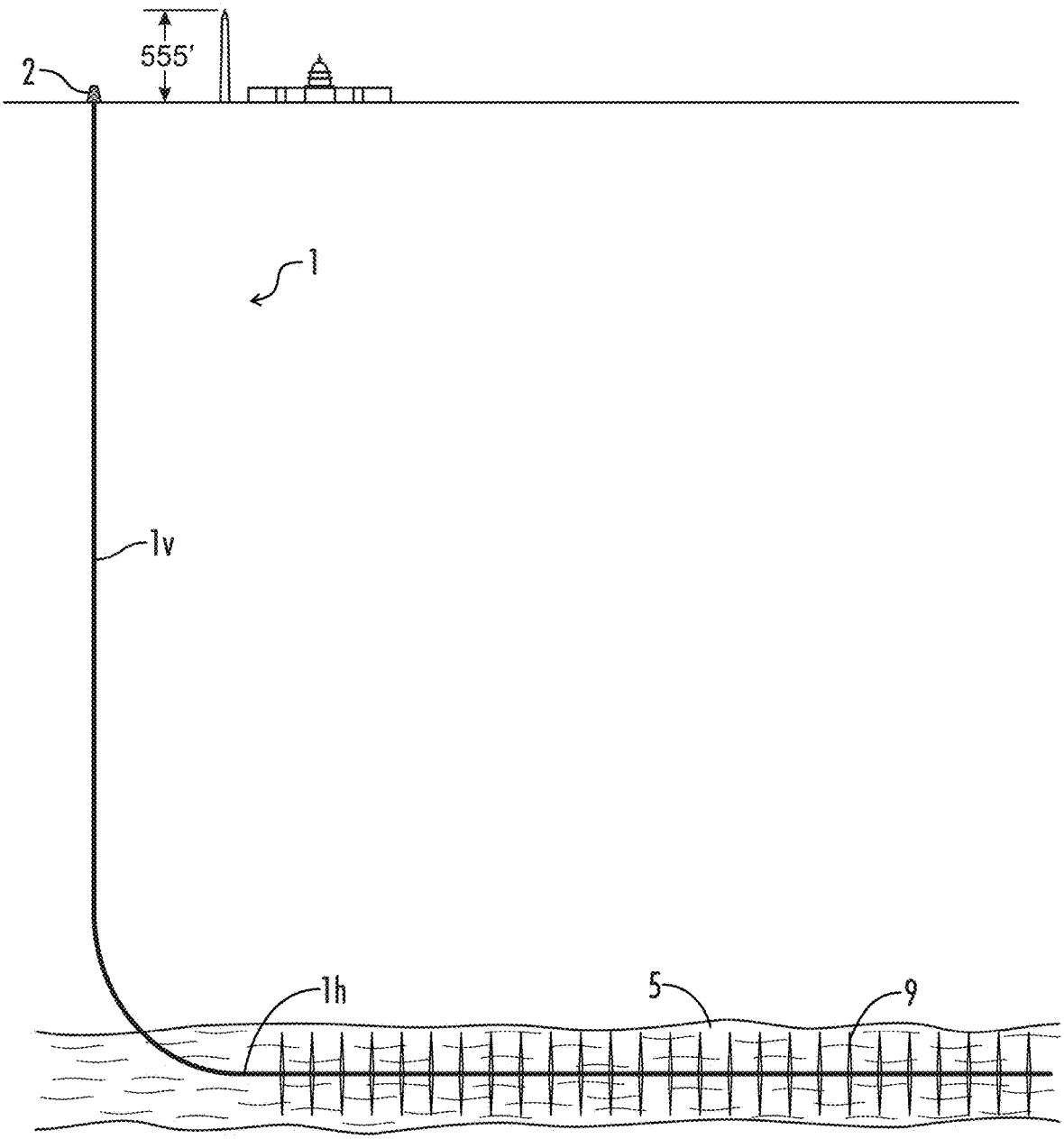
FIG. 1 (prior art) is a schematic depiction in approximate scale of an oil and gas well 1 having a vertical extension 1*v* and a horizontal extension 1*b*.

In the drawings and description that follows, like parts are identified by the same reference numerals. The drawing figures also are not necessarily to scale. Certain features of the embodiments may be shown exaggerated in scale or in somewhat schematic form and some details of conventional design and construction may not be shown in the interest of clarity and conciseness. For example, certain features and components of the embodiments shown in the figures have been omitted to better illustrate the remaining components.

DESCRIPTION OF ILLUSTRATIVE EMBODIMENTS

The invention, in various aspects and embodiments, is directed generally to plugs that may be used to isolate a portion of a well, and more particularly, to plugs that may be used in fracturing or other processes for stimulating oil and gas wells. In general, the novel plugs have an expandable body and a cone. The cone is motivated by fluid pressure, that is, gas or hydraulic pressure and is urged downward into the expandable body to expand the body and set and seal the plug.

Various specific embodiments will be described below. For the sake of conciseness, however, all features of an actual implementation may not be described or illustrated. In developing any actual implementation, as in any engineering or design project, numerous implementation-specific decisions must be made to achieve a developer's specific goals. Decisions usually will be made consistent within system-related and business-related constraints. Specific goals may vary from one implementation to another. Development efforts might be complex and time consuming and may involve many aspects of design, fabrication, and manufacture. Nevertheless, it should be appreciated that such development projects would be routine effort for those of ordinary skill having the benefit of this disclosure.

Overview of Fracturing Operations

The complexity and challenges of completing and producing a well perhaps may be appreciated by reference to FIG. 1. FIG. 1 shows a well 1 approximately to scale. Well 1 includes a vertical portion 1*v* and a horizontal or "lateral" portion 1*b*. Schematic representations of the Washington Monument, which is 555 feet tall, and the Capital Building are shown next to a derrick 2 to provide perspective as to the depth and run of well 1. Well 1 has a vertical depth of approximately 6,000 feet and a horizontal reach of approximately 6,000 feet. Such wells are typical of wells in the Permian Basin, an oil-rich basin located mostly in Texas. Deeper and longer wells, however, are constructed both in the Permian and elsewhere. For example, wells have been drilled with horizontal sections exceeding 24,000 feet, that is, exceeding four and a half miles. While neither the vertical portion 1*v* nor the horizontal portion 1*h* of well 1 necessarily run true to vertical or horizontal, FIG. 1 provides a general sense of what is involved in oil and gas production. Well 1 is targeting a relatively narrow hydrocarbon-bearing formation 5, and all downhole equipment must be installed and operated far away from the surface.

Figure 2A:
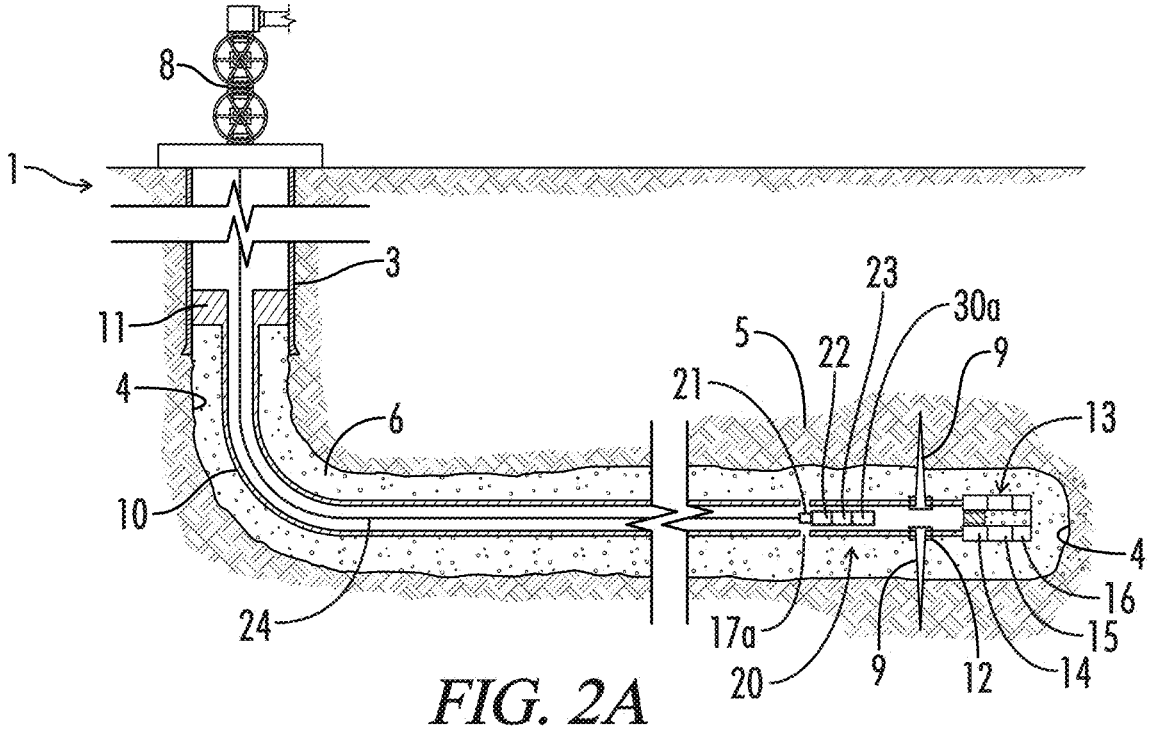
FIG. 2A is a schematic illustration of an early stage of a plug and perf fracturing operation which shows a wireline tool string 20 deployed through a wellhead assembly 8 into a liner assembly 10, where tool string 20 includes a perf gun 21, an ignitor tool 22, a power charge tool 23, and a first preferred embodiment 30*a* of the frac plugs of the subject invention.
Figure 2B:
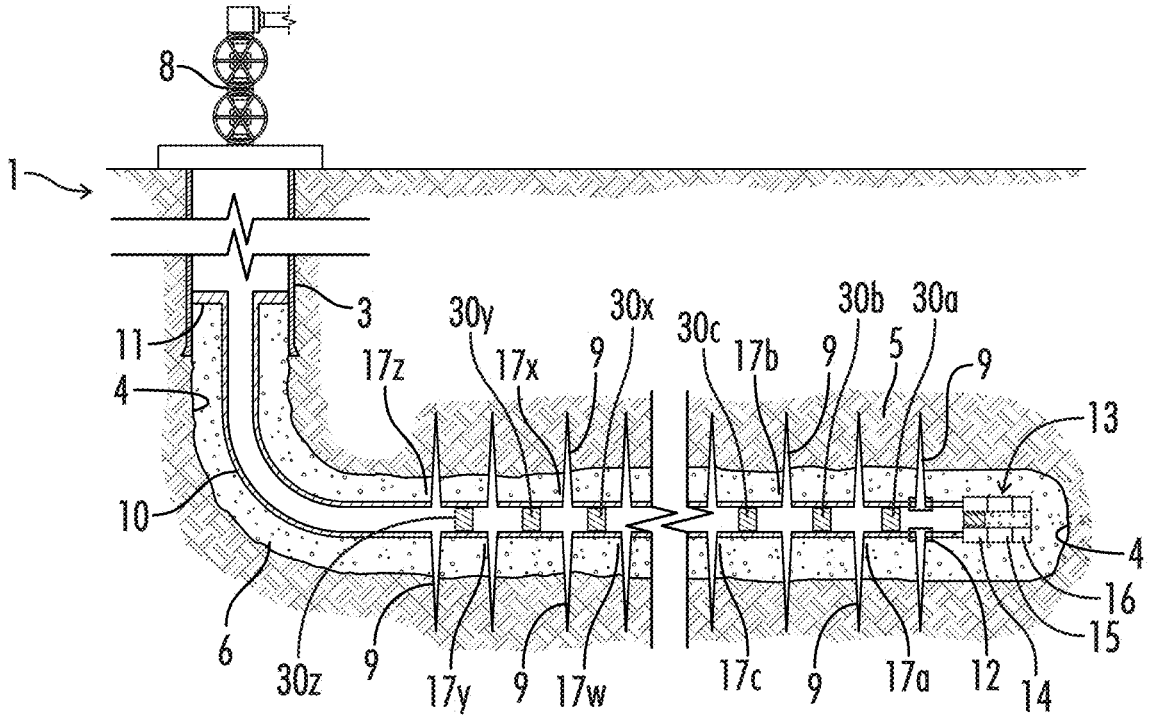
FIG. 2B is a schematic illustration of liner assembly 10 after completion of the plug and perf fracturing operation, but before removal of novel frac plugs 30 from liner 10.

FIGS. 2A and 2B (collectively FIG. 2) illustrate schematically a conventional "plug and perf" job employing a first preferred embodiment 30 of the novel frac plugs. As shown in FIG. 2A, the upper portion of a well 1 is provided with a casing 3, while the lower portion is an open bore 4 extending generally horizontally through a hydrocarbon bearing formation 5.

A liner assembly 10 has been suspended from casing 3 by a liner hanger 11. Liner assembly 10 extends through open bore 4 and includes various tools, such as a "toe" or "initiator" valve 12 and a float assembly 13. Float assembly 13 typically includes various tools that assist in running liner 10 into well 1 and cementing it in bore 4, such as a landing collar 14, a float collar 15, and a float shoe 16.

Liner 10 has been cemented in bore 4 and the initial stage of a frac job has been completed. That is, cement 6 completely fills the annulus between liner 10 and bore 4. Toe valve 12, having been run in on liner 10 in its shut position, has been opened. Fluid has been pumped through a wellhead assembly 8, down liner 10, and into formation 5 via open toe valve 12. The fluid has created fractures 9 extending from toe valve 12 in a first zone near the bottom of well 1.

A typical frac job will proceed in stages from the lowermost zone in a well to the uppermost zone. Thus, FIG. 2A shows a "plug and perf" tool string 20 that has been run through wellhead assembly 8 and into liner 10 on a wireline 24. Tool string 20 comprises a perf gun 21, an ignitor tool 22, a power charge tool 23, and a first novel frac plug 30*a*. Tool string 20 is positioned in liner 10 such that frac plug 30*a* is uphole from toe valve 12. Frac plug 30*a* is coupled to power charge tool 23 and, as described further below, will be installed in liner 10 by energizing an ignitor in ignitor tool 22 through wireline 24 to ignite a combustible power charge 73 carried in power charge tool 23. Once plug 30*a* has been installed, power charge tool 23 will be released from plug 30*a*. Perf gun 21 then will be fired to create perforations 17*a* in liner 10 uphole from plug 30*a*. Perf gun 21, ignitor tool 22, and power charge tool 23 then will be pulled out of well 1 by wireline 24.

Once frac plug 30*a* has been set it will restrict the downward flow of fluids past plug 30*a*. Plug 30*a*, therefore, will substantially isolate the lower portion of well 1 and the first fractures 9 extending from toe valve 12. Fluid then can be pumped into liner 10 and forced out through perforations 17*a* to create fractures 9 (shown in FIG. 2B) in a second zone. After fractures 9 have been sufficiently developed, pumping is stopped and valves in wellhead assembly 8 will be closed to shut in the well 1. After a period of time, fluid will be allowed to flow out of fractures 9, through liner 10 and casing 3, to the surface.

Additional plugs 30*b* to 30*z* then will be run into well 1 and set, liner 10 will be perforated at perforations 17*b* to 17*z*, and well 1 will be fractured in succession as described above until, as shown in FIG. 2B, all stages of the frac job have been completed and fractures 9 have been established in all zones. Once the fracturing operation has been completed, plugs 30 typically will be removed or from liner 10. Production equipment then will be installed in the well and at the surface to control production from well 1.

Frac Plug 30

Figure 3:
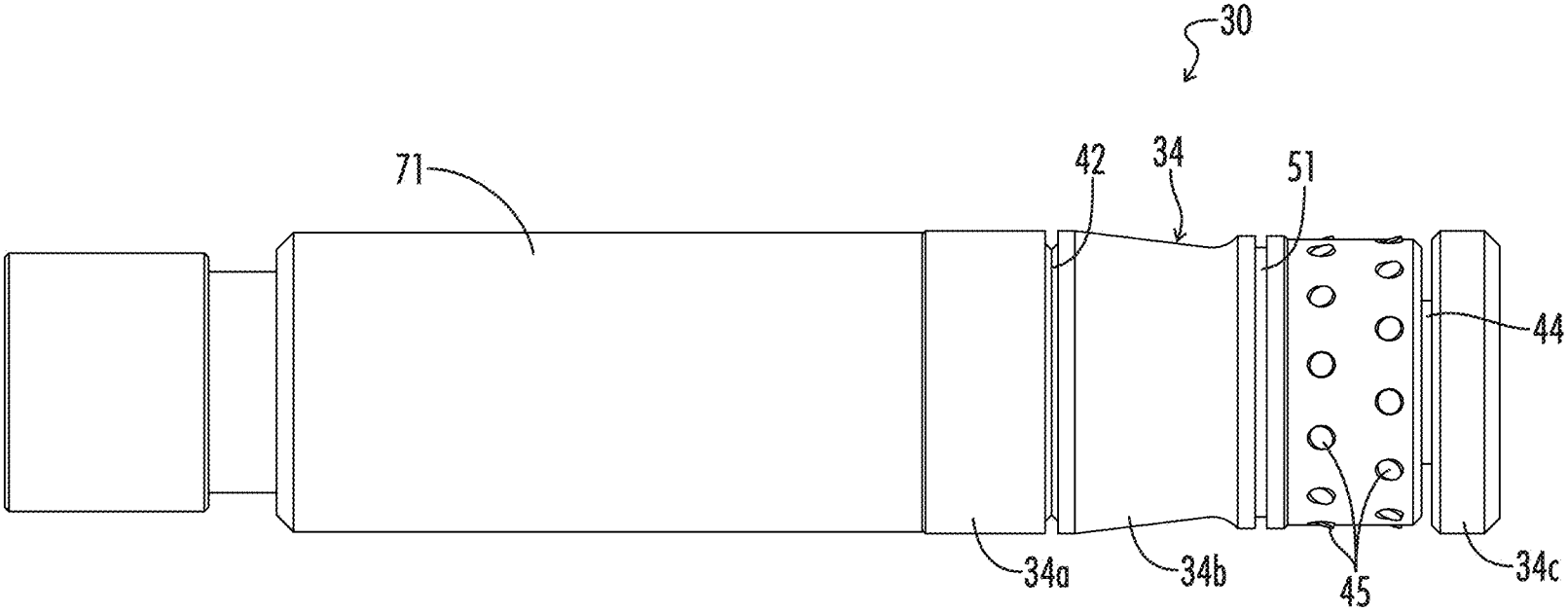
FIG. 3 is a side elevational view of an assembly of novel frac plug 30 and a first preferred pressure chamber sub 71 of power charge tool 23 illustrated schematically in FIGS. 1 and 2.
Figure 4A:
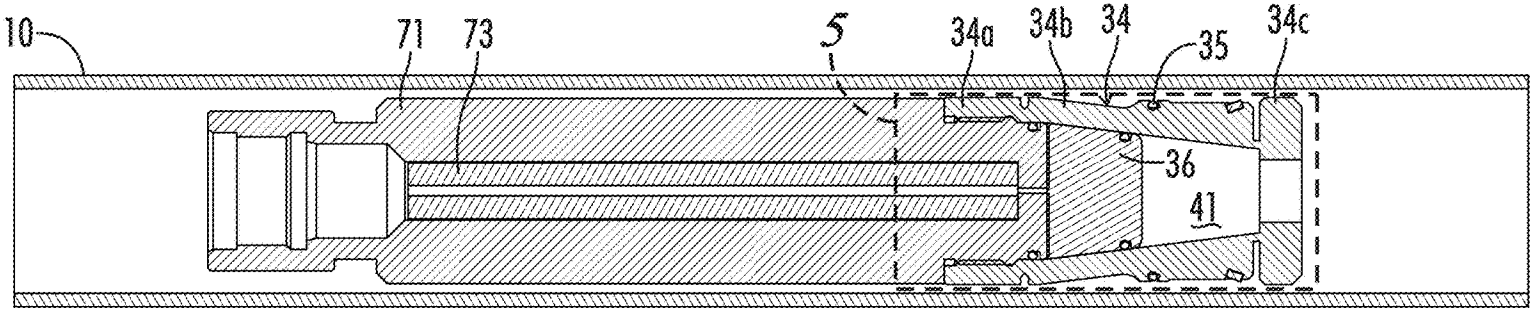
FIG. 4A is an axial cross-sectional view of the assembly of novel frac plug 30 and pressure chamber sub 71 shown in FIG. 3, where frac plug 30 is its run-in, unset state and a combustible power charge 73 is mounted in pressure chamber sub 71 of power charge tool 23.
Figure 4B:
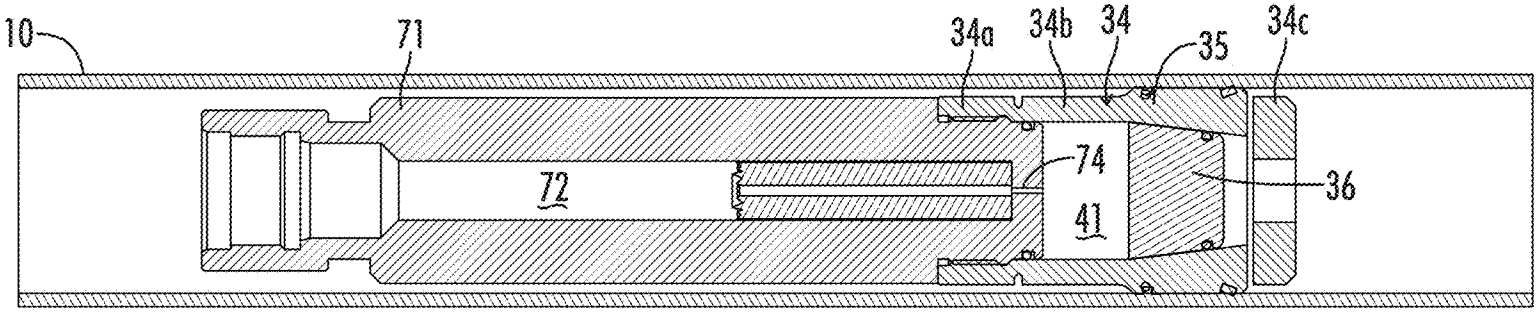
FIG. 4B is an axial cross-sectional view of the assembly shown in FIGS. 3 and 4A where novel frac plug 30 in its set state and power charge 73 is partially combusted.
Figure 4C:
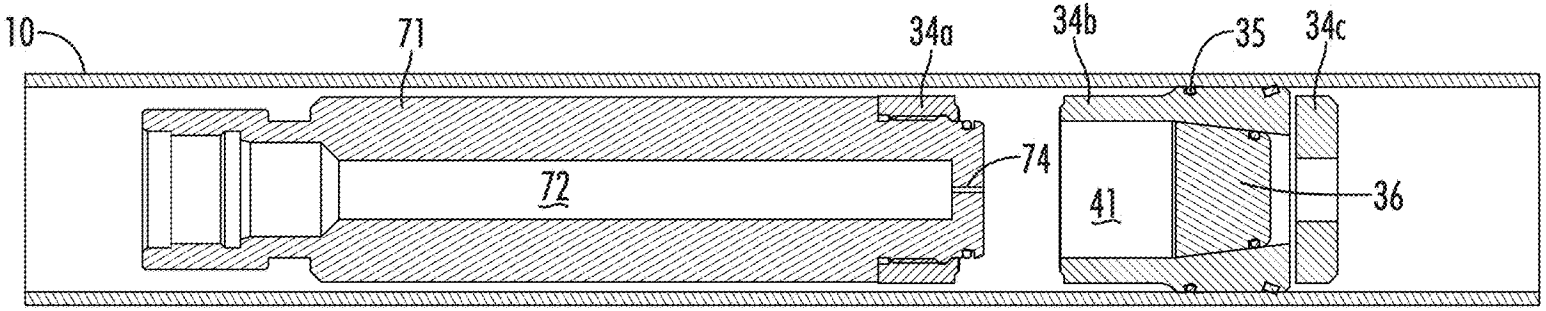
FIG. 4C is an axial cross-sectional view of the assembly shown in FIGS. 3, 4A, and 4B where novel frac plug 30 in its set state with pressure chamber sub 71 having separated from frac plug 30.
Figure 5:
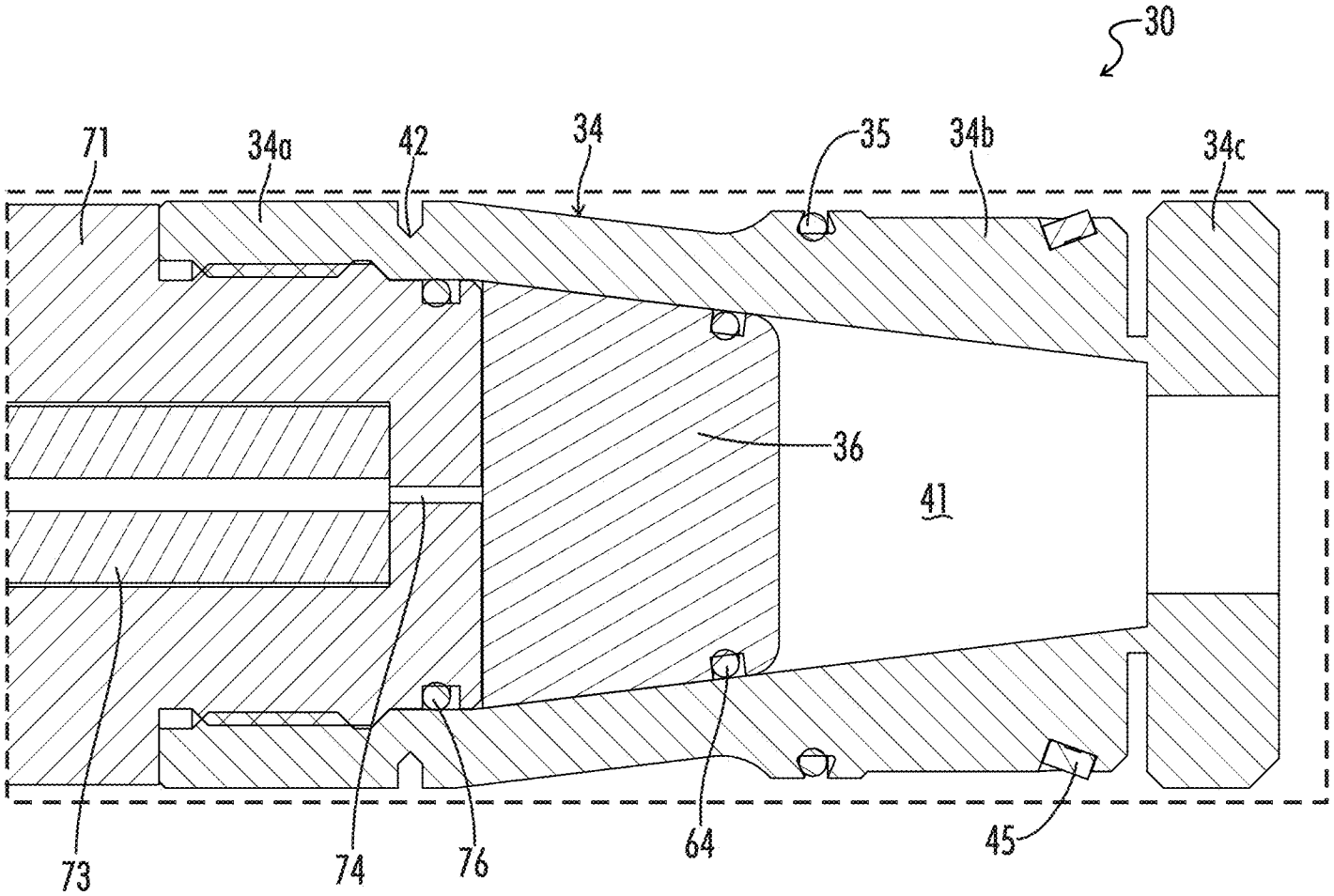
FIG. 5 is an enlarged, cross-sectional view of novel frac plug 30 taken from area 5 of FIG. 4A showing frac plug 30 in its unset state.

A first embodiment 30 of the novel frac plugs is shown in greater detail in FIGS. 3-5 (FIGS. 4A, 4B, and 4C collectively FIG. 4). As may be seen best in FIG. 5, frac plug 30 generally comprises a radially expandable body 34, a radially expandable sealing ring 35, and a cone 36. Radially expandable body 34, as described further below, provides a radially expandable slip. Thus, when described in reference to novel frac plug 30, radially expandable body 34 will be referred to as radially expandable slip 34. Sealing ring 35 is mounted around the outer circumference of slip 34, for example, in an annular seal gland 51 shown in FIG. 3. Slip 34 and sealing ring 35, as described further below, have nominal outer diameters when frac plug 30 is in an unset state and have enlarged outer diameters when frac plug 30 is placed in a set state. Slip 34 and sealing ring 35 will be radially expanded to engage the inner wall of, for example, liner 10 when frac plug 30 is in its set state.

Slip 34 has a bore 41 extending axially along the primary (lengthwise) axis of frac plug 30. Slip bore 41 provides slip 34 with a tapered inner surface generally defining an inverted, truncated conical surface. The tapered inner surface decreases in diameter from the upper extent of the tapered inner surface toward the lower extent of the tapered inner surface.

Cone 36 occludes slip bore 41 and is adapted to radially expand slip 34 and, indirectly, sealing ring 35. The body of cone 36 is a truncated inverted solid cone. It has a tapered outer surface engaging the tapered inner surface of slip 34. The tapered outer surface of cone 36 decreases in diameter from the upper extent of the tapered outer surface toward the lower extent of the tapered outer surface, thus providing a generally inverted truncated conical surface. Tapered outer surface of cone 36 and the tapered inner surface of slip 34 have complimentary angles. A pressure seal 64 preferably is provided between cone 36 and slip 34. Pressure seal 64 may be mounted, for example, in an annular gland in cone 36.

Cone 36 is adapted for displacement from an unset position in an upper portion of slip bore 41 to a set position in a lower portion of slip bore 41. As described further below, cone 36 moves from its unset position to its set position in response to increased fluid pressure above cone 36. As it moves from its set position to its unset position, cone 36 expands slip 34 radially into engagement with the inner wall of, for example, liner 10. As is expanded radially by cone 36, slip 34 in turn will expand sealing ring 35 into contact with liner 10 to provide a pressure seal between frac plug 30 and liner 10.

The novel frac plug tool assemblies comprise a novel frac plug coupled to a fluid pressure generator tool, such as power charge tool 23, that is adapted to generate fluid pressure that is communicated into frac plug 30 above cone 36. As shown in the cross-sectional view of FIG. 4A, power charge tool 23 comprises a pressure chamber sub 71 and a combustible power charge 73. As illustrated schematically in FIG. 2A, power charge tool 23 is coupled at its lower end to the upper end of frac plug 23 by a pressure-tight connection. It is coupled at its upper end to ignitor tool 22 by a pressure-tight connection.

More specifically, pressure chamber sub 71 is coupled to slip 34, for example, by a threaded connection. It has an open, generally cylindrical body that, by virtue of the pressure-tight connections with ignitor tool 22 and frac plug 30, defines a pressure chamber 72. Pressure chamber 72 in sub 71 communicates with the upper portion of slip bore 41 and the upper face of cone 36 through a port 74 in the lower end of pressure chamber sub 71, thus effectively extending pressure chamber 72 into the upper portion of frac plug 30.

Pressure chamber sub 71 is adapted to accommodate combustible power charge 73. Power charge 73 is operably connected to an ignitor in ignitor tool 22. When ignited by the ignitor, power charge 73 will burn and generate gaseous combustion products, increasing pressure in pressure chamber 72 and generating force against the upper face of cone 36.

Preferably, as seen best in FIG. 5, slip 34 comprises an integral, upper, non-expanded portion 34*a*, an integral, lower expandable portion 34*b*, and a gauge ring portion 34*c*. Non-expanded portion 34*a* and expandable portion 34*b* are joined by a relatively weak bridging portion 42. When plug 30 is in its unset state, cone 36 is positioned below non-expanded portion 34*a* of slip 34 and within expandable portion 34*b*. Pressure chamber sub 71 of power charge tool 23 is coupled to non-expanded portion 34*a* of slip 34. A pressure seal 76 preferably is provided between pressure chamber sub 71 and slip 34. As described further below, weak bridging portion 42 allows non-expanded portion 34*a* and expandable portion 34*b* to break apart in a controlled manner.

Gauge ring 34*c* is joined to lower non-expanded portion 34*b* by a relatively weak bridging portion 44 adapted to break in a controlled manner. When plug 30 is in its unset a state, non-expanded portion 34*a*, expandable portion 34*b*, and gauge ring 34*c* form an integral component, that is, slip 34. The outer diameter of gauge ring 34*c* is somewhat larger than that of the rest of slip 34. Thus, gauge ring 34*c* assists in guiding plug 30 as it is deployed through liner 10. It also can protect the upper elements of slip 34 from catching on debris, protrusions, and the like that might cause plug 30 to lodge within liner 10 before reaching the desired depth at which it will be installed.

Plug 30 may be deployed and installed in a well by coupling it to a wireline tool string, such as tool string 20 on wireline 24. In general, cone 36 will be driven into slip 34 forcing slip 34 to expand radially into gripping contact with liner 10 as shown in sequenced FIG. 4. More specifically, plug 30 in its unset state shown in FIG. 4A is deployed to a desired location in liner 10 as shown schematically in FIG. 2A. A signal then will be sent through wireline 24 to the ignitor in ignitor tool 22, igniting combustible power charge 73 in pressure chamber sub 71. As combustible power charge 73 burns, more and more gas is released, increasing fluid pressure against the upper surface of cone 36.

As fluid pressure increases, cone 36 will be urged downward, further into axial bore 41 of slip 34 as shown in FIG. 4B. As it travels downward, cone 36 causes expandable portion 34*b* of slip 34 and, in turn, sealing ring 35 to expand radially outward into contact with the inner wall of liner 10. As expandable portion 34*b* expands, bridging portions joining gauge ring 34*c* thereto are broken. At this point, plug 30 is set, a pressure seal is established between plug 30 and liner 10, and gauge ring 34*c* is separated from the rest of plug 30.

As power charge 73 continues to burn and fluid pressure within pressure chamber sub 71 continues to increase, and as cone 36 has stopped moving downward, axial tensile forces across bridging portion 42 joining non-expanded portion 34*a* and expandable portion 34*b* will increase rapidly. As shown in FIG. 4C, bridging portion 42 will break, allowing non-expanded portion 34*a* to break away from the rest of slip 34, that is, expandable portion 34*b*. As non-expanded portion 34*a* and pressure chamber sub 71 shift upwards, fluid pressure within sub 71 and plug 30 will be released. Once liner 10 is perforated, sub 71 and the other uphole tools in tool string 20 may be pulled out of liner 10. Plug 30 then will be fully installed as depicted schematically in FIG. 2B, and frac fluid may be pumped into liner 10.

Plug 30 may comprise ratchet teeth or other designs for ensuring that cone 36, once it has been driven down into slip 34, remains in place. For example, depending on the material from which they are fabricated, a self-locking fit may be provided between the tapered outer surface of cone 36 and the tapered inner surface of slip 34.

The outer surface of slip 34 also preferably is provided with features to assist slip 34 in engaging and gripping liner 10 when frac plug 30 is set. Thus, for example, slip 34 may be provided with high-strength or hardened particles, grit, or inserts, such as buttons 45. Buttons 45 may be mounted in suitable bottomed holes in the outer surface of slip 34. They may be fabricated from, for example, a ceramic material containing aluminum, such as a fused alumina or sintered bauxite, or zirconia, such as CeramaZirc available from Precision Ceramics. Buttons 45 also may be fabricated from heat treated steel or cast iron, fused or sintered metals and other high-strength materials, or carbides such as tungsten carbide. The precise number and arrangement of buttons 45 or other such components may be varied. The outer surface of slip 34 also may be provided with teeth or serrations in addition to or in lieu of buttons or other gripping features.

It will be appreciated that novel frac plug 30 reduces the complexity and cost of wireline tool strings used in plug and perf jobs. That is, the novel frac plugs eliminate the need for a mechanical tool to convert fluid pressure from a power charge tool into mechanical power and to transmit the mechanical power to the frac plug. They are designed to allow fluid pressure to act directly on the plug components. As noted, fracturing a well may involve 50, and perhaps over a hundred different stages. Each stage requires a wireline tool assembly to be assembled at the surface, run into and out of the well, and then disassembled. Thus, the novel frac plugs create the opportunity to reduce significantly the manpower and equipment costs of a frac job.

Frac Plug 130

Figure 6:
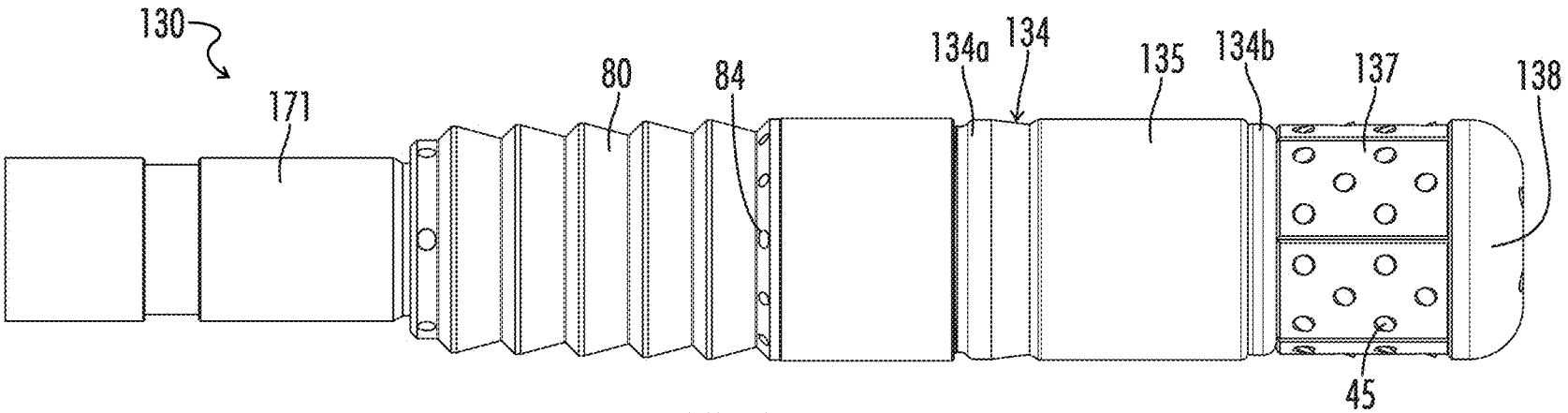
FIG. 6 is a side elevational view of an assembly of a second preferred embodiment 130 of the frac plugs of the subject invention and a second preferred pressure chamber sub 171 of a power charge tool.
Figure 7:
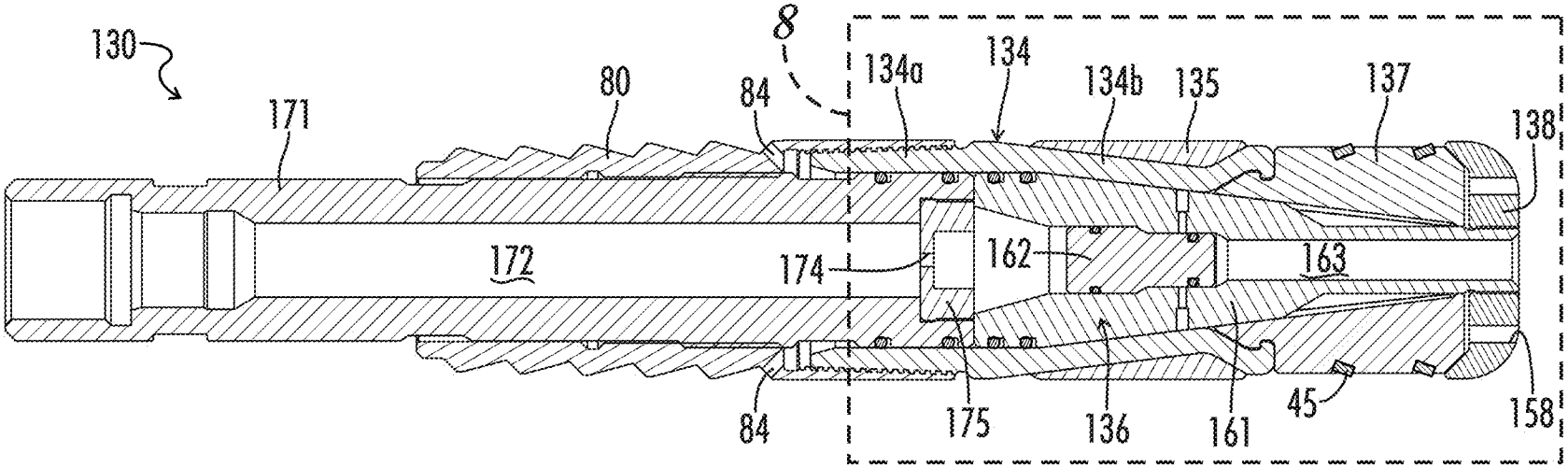
FIG. 7 is an axial cross-sectional view of the assembly of novel frac plug 130 and pressure chamber sub 171 shown in FIG. 6 where frac plug 130 is in its run-in, unset state.
Figure 8:
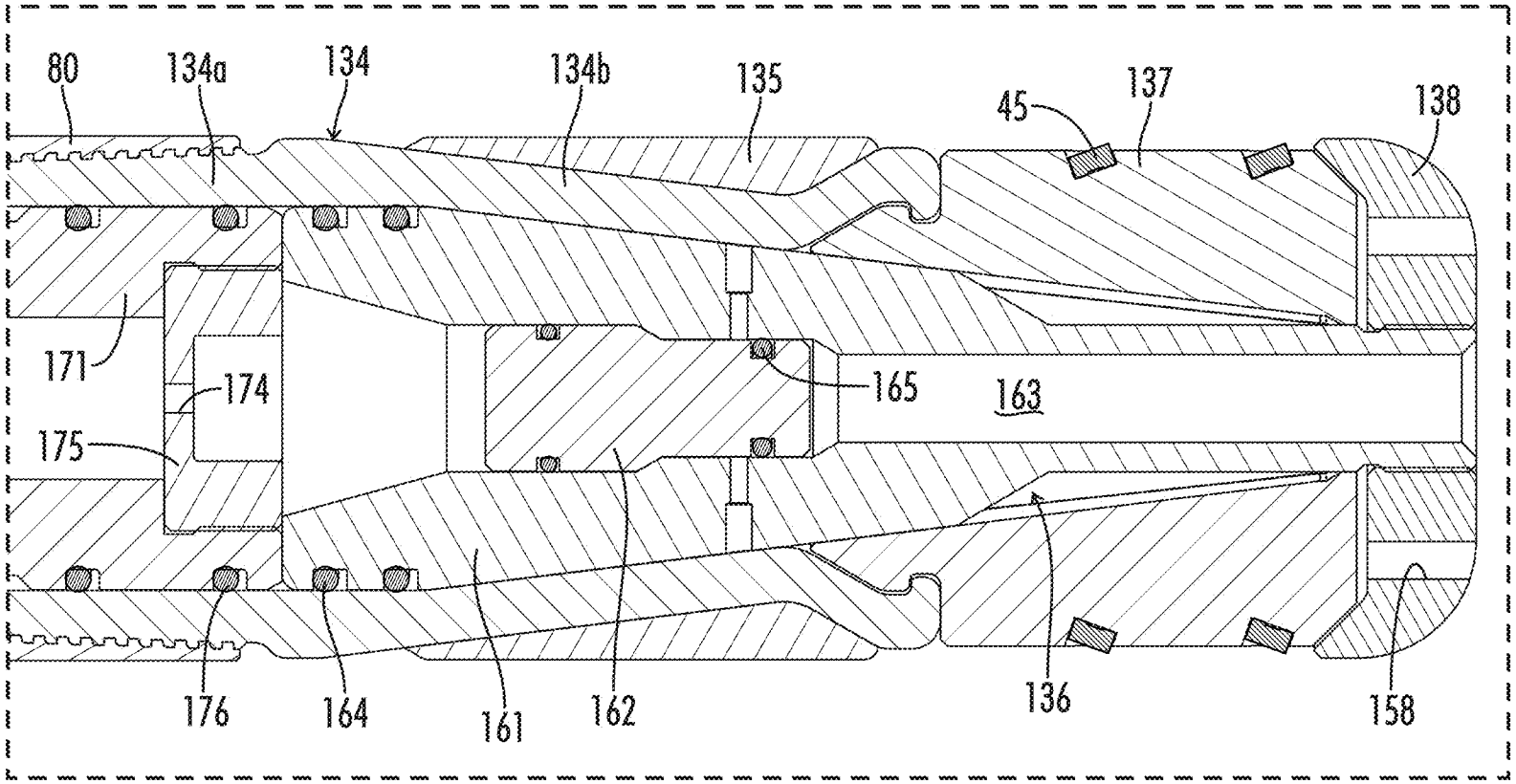
FIG. 8 is an enlarged, cross-sectional view of novel frac plug 130 taken from area 8 of FIG. 7.

A second embodiment 130 of the novel frac plugs is shown in FIGS. 6-8. As may a be seen best in the cross-sectional views of FIGS. 7-8, frac plug 130 generally comprises a radially expandable body 134, a radially expandable sealing ring 135, a cone 136, a plurality of radially displaceable slips 137, and a gauge ring 138. As described further below, and like novel frac plug 30, novel frac plug 130 is installed in a liner by generating fluid pressure that drives cone 136 down into expandable body 134.

Radially expandable body 134 has a profiled, but generally open-cylindrical geometry defining a bore extending axially along the primary axis of frac plug 130. Preferably, body 134 comprises an upper, non-expanded portion 134*a* and a lower, expandable portion 134*b*. Like bore 41 in the lower, expandable portion 34*b* of slip 34 of novel frac plug 30, the body bore of novel frac plug 130 has a tapered inner surface through expandable portion 134*b* of body 134. The tapered inner surface generally defines an inverted, truncated conical surface decreasing in diameter from the upper extent of the tapered inner surface toward the lower extent of the tapered inner surface.

Sealing ring 135 is mounted around the outer circumference of expandable portion 134*b* of body 134. Expandable portion 134*b* of body 134 and sealing ring 135, as described further below, have nominal outer diameters when frac plug 130 is in an unset state and have enlarged outer diameters when frac plug 130 is placed in a set state. Body 134 and sealing ring 135 will be radially expanded such that sealing ring 135 engages the inner wall of, for example, liner 10 when frac plug 130 is in its set state. Similarly, slips 137 will be displaced radially outward such that they engage the inner wall of liner 10.

When plug 130 is in its run-in, unset state, as shown in FIGS. 6-8, cone 136 is positioned below non-expanded portion 134*a* of body 134 and within expandable portion 134*b*. Like cone 36 in frac plug 30, cone 136 occludes the axial bore in body 134. It also is adapted to expand radially expandable portion 134*b* of body 134, to indirectly expand sealing ring 135, and to radially displace slips 137. Unlike cone 36 in frac plug 30, however, cone 136 comprises an assembly of a wedge 161 and a stopper 162. Stopper 162 is mounted in a bore 163 extending axially through wedge 161 along the primary axis of frac plug 130. Preferably, as discussed further below, it is releasably mounted in bore 163 of wedge 161.

Wedge 161 has a tapered outer surface engaging the tapered inner surface of expandable portion 134*b* of body 134. The tapered outer surface of wedge 161 decreases in diameter from its upper extent toward its lower extent, thus providing wedge 161 with a generally inverted truncated conical outer surface. Tapered outer surface of wedge 161 and the tapered inner surface of body 134 have complimentary angles. A pair of pressure seals 164 preferably are provided between wedge 161 and body 134. Pressure seals 164 may be mounted, for example, in annular glands in wedge 161.

Bore 163 extending through wedge 161 has a series of cylindrical portions connected by tapers. More particularly, the upper open end of bore 163 tapers radially inward leading to a first or upper cylindrical portion. The upper cylindrical portion tapers radially inward into a second or middle cylindrical portion, thus providing bore 163 extending through wedge 161 with an upper inwardly tapered, upward-facing shoulder. The middle cylindrical portion of bore 163 tapers radially inward into a third or lower cylindrical portion extending substantially to the lower open end of wedge 161 and provides a lower, inwardly tapered, upward-facing shoulder.

Stopper 162 has a generally solid-cylindrical configuration except that a lower portion of stopper 162 had a reduced diameter relative to an upper portion thereof. The upper and lower portions are connected by an inwardly tapered portion. Thus, when mounted in bore 163 of wedge 161, stopper 162 is seated on the upper shoulder in bore 163 of wedge 161. Flow through radially expandable body 134, therefore, is shut off by the assembly of wedge 161 and stopper 162. Preferably, a pair of pressure seals 165 are provided between stopper 162 and wedge 161. They may be mounted, for example, in grooves provided in the outer surface of stopper 162.

Gauge ring 138 is coupled to the lower end of wedge 161, for example, by threaded connections designed to shear in a predictable and controlled manner. The outer diameter of gauge ring 138 is somewhat larger than that of the rest of plug 130. Thus, gauge ring 138 assists in guiding and protecting plug 130 as it is deployed through liner 10. When gauge ring 138 is fabricated from dissolvable metal, as shown in FIG. 8 and discussed further below, it preferably is provided with one or more open or "dissolution" passages 158 that increase the surface area of gauge ring 138 that is exposed to fluids in liner 10. Such dissolution passages are adapted to control the rate at which gage ring 138 dissolves or otherwise deteriorates in the presence of downhole well fluids.

Plug 130 is provided with six slips 137, although a greater or lesser number may be provided. Slips 137 are mounted around and on the lower portion of wedge 161. They are adapted to be shifted radially outward into engagement with a liner as cone 136 is displaced axially within body 134 from its run-in, unset position to its set position. Each slip 137 has the general geometry of an axial cylinder segment. Collectively, when plug 130 is in its a run-in state and they are mounted around wedge 161, slips 137 have a generally open cylindrical shape. The inner surface of each slip 137 is tapered, such that collectively they define a tapered, inner axial passage extending generally from the upper end of slips 137 to their lower end. The diameter of the passage diminishes from the upper ends to the lower ends of slips 137 at an angle complimentary to the angle of the tapered outer surface of wedge 161.

As may be seen best in FIG. 8, when plug 130 is in its run-in state slips 137 are captured between body 134 and gage ring 138. More particularly, the lower end of expandable portion 134*b* of body 134 is provided with a hook-like catch. The catch engages a corresponding groove in the outer surface of the upper portion of slips 137. The lower end of slips 137 is chamfered. Gage ring 138 has a chamfered rim, thus allowing the lower end of slips 137 to nest within gage ring 138. Other interlocking geometries may be used, however, to capture slips 137 between body 134 and gage ring 138. Likewise, slips 137 are discrete components, but an array of breakaway-type slips, wherein the slips are joined by frangible connections, also may be used in the novel plugs. Other conventional slip designs are known and may be used if desired.

Slips 137 also preferably will be provided with features to assist them in engaging and gripping liner 10 when frac plug 130 is set. As in plug 30, the outer surface of slips 137 may be provided with teeth or serrations, high-strength or hardened particles, grit, or inserts, such as buttons 45. Likewise, plug 130 may comprise ratchet or other mechanism to ensure that wedge 161, once it has been driven down into body 134, remains in place. Depending on the material from which they are fabricated, a self-locking fit also may be provided between the tapered outer surface of wedge 161 and the tapered inner surfaces of body 134 and slips 137.

Cone 136 is adapted for displacement from an unset position (shown in FIGS. 7-8) in an upper portion of the tapered bore in expandable portion 134*a* to a set position in a lower portion of the tapered bore. As with cone 36 of frac plug 30, cone 136 moves from its unset position to its set position in response to increased fluid pressure above cone 136. As it moves from its set position to its unset position, cone 136 radially expands expandable portion 134*b* of body. As is expanded radially by cone 136, expandable portion 134*a* of body 134 in turn will expand sealing ring 135 into contact with liner 10 to provide a pressure seal between frac plug 130 and liner 10. As cone 136 is driven lower, it also displaces slips 137 radially outward and into contact with the inside of liner 10, thus setting plug 130 in liner 10.

Like frac plug 30, novel frac plug 130 may be assembled to a fluid pressure generator tool for installation in a liner. The power charge tool generates fluid pressure that is communicated into frac plug 130 above cone 136. Suitable power charge tools may comprise, as shown in FIGS. 6-7, a pressure chamber sub 171, combustible power charge 73 (not shown), and a gas metering plug 175. Pressure chamber sub 171 and gas metering plug 175 are the functional equivalent of pressure chamber sub 71 of power charge tool 23. Pressure chamber sub 171 is generally cylindrical and is adapted to accommodate combustible power charge 73. Gas metering plug 175 is mounted, for example, by threaded connections over the lower, open end of pressure chamber sub 171.

Gas metering plug 175, like the substantially closed lower end of pressure chamber sub 71 in power charge tool 23, has a port 174. Port 174 allows fluid pressure generated within pressure chamber 172 to communicate with the upper portion of the bore in body 134 and the upper face of cone 136. Thus, when ignited by an ignitor, power charge 73 will burn and generate increasing fluid pressure against the upper face of cone 136 to urge it downward within expandable body 134.

Like power charge tool 23, pressure chamber sub 171 can be coupled at its upper end to ignitor tool 22 by a pressure-tight connection. It may be directly coupled at its lower end to expandable body 134, for example, by shearable threads. Preferably, however, it is indirectly coupled to frac plug 130 by a preferred embodiment 80 of the novel pump-down sleeves.

Pump-down sleeve 80 has a generally cylindrical geometry having a profiled outer surface as described further below. Its lower end has an enlarged diameter portion that allows it to slip over and connect to the upper end of body 134, for example, by threaded connections with the exterior of non-expanded portion 134*a* of body 130. The threads will be designed to strip in a controlled and predictable manner. Pressure chamber sub 171 extends through the interior of pump-down sleeve 80 and is connected thereto, for example, by threaded connections. The lower end of pressure chamber sub 171, when pump-down a sleeve 80 is assembled to body 134, is closely fitted with the bore of non-expanded portion 134*b* of body 134. Preferably, pressure seals 176 are provided between the lower end of pressure chamber sub 171 and expandable body 134. They may be mounted, for example, in annular glands provided in the outer circumference of pressure chamber sub 171.

Plug 130 may be deployed and installed in a well in the same manner as plug 30, for example, by assembling it into a wireline tool string. When plug 130 is in place, an ignitor tool will ignite combustible power charge 73 in pressure chamber sub 171 to generate increasing fluid pressure against the upper surface of cone 136. As fluid pressure increases, cone 136 will be urged downward, further into the axial bore of body 134 to seal and set plug 130.

As it travels downward, cone 136 radially expands expandable portion 134*b* of body 134. Body 134 in turn radially expands sealing ring 135 outward into contact with the inner wall of liner 10. As it continues downward, cone 136 displaces slips 137 radially outward and into gripping engagement with liner 10. As they are displaced radially, slips 137 also will cause the threaded connection between gage ring 138 and the lower end of wedge 161 to strip, releasing gage ring 138. At this point, plug 130 is set and a pressure seal is established between plug 130 and liner 10.

As pressure continues to increase within frac plug 130, it will cause the threaded connection between pump-down sleeve 80 and nonexpendable portion 134*a* of plug body 134 to strip. Pump-down sleeve 80, the power charge tool, and the other tools in the tool string assembly are thereby released from now set and sealed frac plug 130. Preferably, as will be appreciated by careful viewing of FIGS. 7 and 8, the threaded connection between pump-down sleeve 80 and plug body 134 is tapered radially outward from its upper to its lower extent. A cleaner, more simultaneous break between pump-down sleeve 80 and frac plug 130 is thereby enhanced.

It will be appreciated that the expandable body in the novel frac plugs are expanded by two distinct mechanisms. In novel frac plug 30, cone 36 applies mechanical force, that is, a swaging force against slip 34 as its is urged downward under fluid pressure. Because seals 64 are situated near the lower end of cone 36, however, fluid can flow into the annular gap between slip 34 and cone 36. Fluid in the gap also exerts a radial force outward against slip 34. Expansion of slip 34, therefore, results from a combination of that swaging force and that fluid pressure, the processes being referred to a swaging and fluid-forming.

In contrast, while a fluid-forming dynamic is not entirely absent, expandable body 134 of novel frac plug 130 is expanded primarily by the swaging action of cone 136. Seals 164 are situated near the upper end of wedge 161. Fluid flow into the annular gap between expandable body 134 and wedge 161 is largely shut off. In both novel plug 30 and 130, however, once set in liner 10, fluid pressure within, respectively, expandable bodies 34 and 134 will reinforce and hold them in their expanded state.

While novel frac plugs 30 and 130 are designed primarily to hold pressure above the plug, in some wells pressure may build up below the plugs. With frac plug 30, for example, excessive downhole pressure may cause cone 36 to be dislodged. Lacking support from cone 36, frac plug 30 may become unset and pushed uphole away from the target zone. Novel frac plug 130, however, addresses such potential problems. As mentioned above, cone 136 of frac plug 130 comprises the assembly of wedge 161 and stopper 162. Stopper 162 preferably is releasably mounted in wedge 161, for example, by shearable screws, pins, threads, and the like. The shearable connections are adapted to shear before downhole pressure rises to a level sufficient to dislodge cone 136 from body 134. Stopper 162 will be dislodged, but wedge 161 will remain in place. Thus, excess downhole pressure will be bled off while reducing the risk that plug 130 will become unset.

Frac Plug 230

Figure 9:
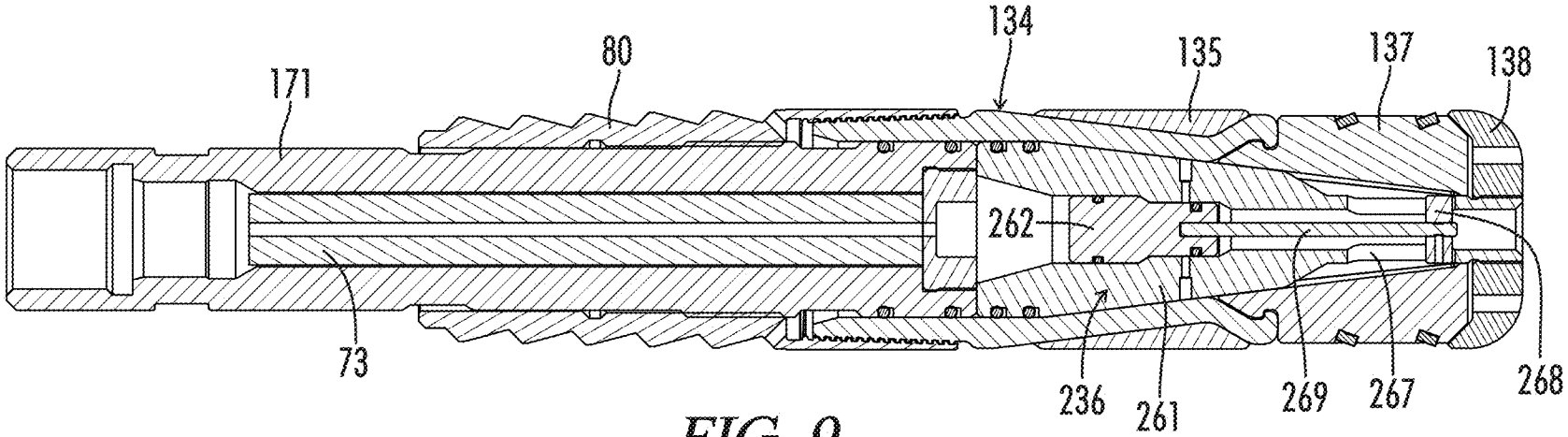
FIG. 9 is an axial cross-sectional view of an assembly of a third preferred embodiment 230 of the frac plugs of the subject invention and pressure chamber sub 171.

A third embodiment 230 of the novel frac plugs is shown in FIG. 9. It is in large part identical to novel frac plug 130. Like frac plug 130, frac plug 230 has a multi-component cone 236 comprising a wedge 261 and a stopper 262. Frac plug 230, however, is designed to ensure that stopper 262, if dislodged from bore 263 of wedge 261 by excessive downhole pressure, will properly reseat in wedge 261 and shut off flow through plug 230 when uphole pressure is restored.

More particularly, the lower end of wedge 261 is provided with a pair of opposing, axially extending lateral slots 267. A traveler 268 extends across slots 267 and is adapted to slide axially therein. A connecting rod 269 is connected to and extends between stopper 262 and traveler 268. If stopper 262 is dislodged from wedge 261, its connection with traveler 268 and rod 269 will ensure that it remains properly oriented for reseating in bore 263 of wedge 261. Cone 236 once again will occlude the bore of body 134, and plug 130 will shut off flow through liner 10 in preparation for fracturing.

Frac Plug 330

Figure 10:
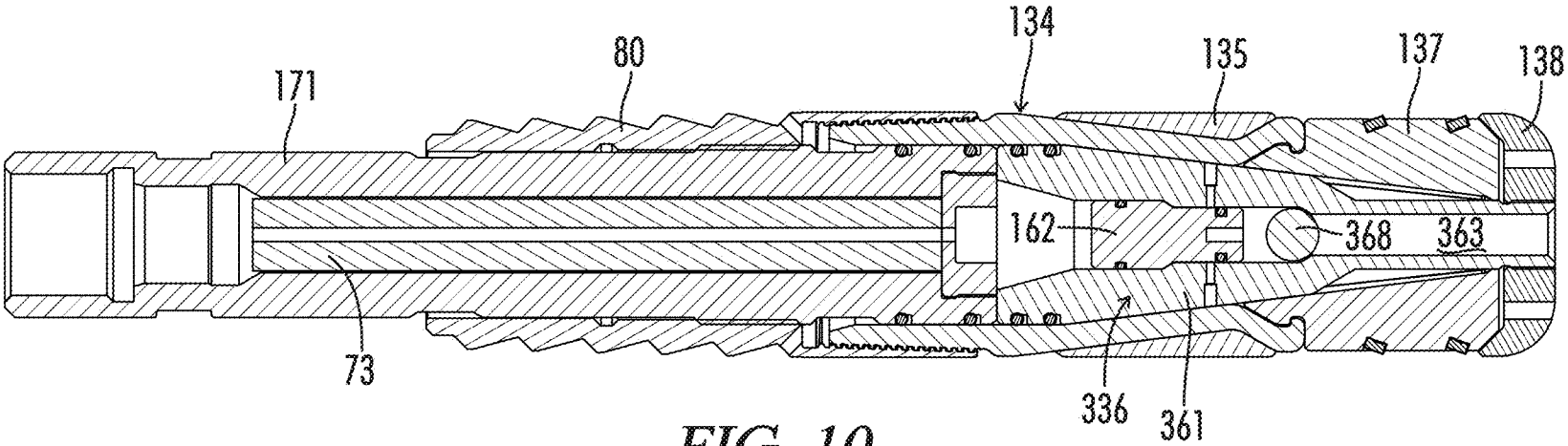
FIG. 10 is an axial cross-sectional view of an assembly of a fourth preferred embodiment 330 of the frac plugs of the subject invention and pressure chamber sub 171.

A fourth embodiment 330 of the novel frac plugs is shown in FIG. 10. It is in large part identical to novel frac plugs 130 and 230. Like frac plug 230, the design of frac plug 330 helps ensure that it will shut off flow through liner 10 even if otherwise excessive downhole pressure builds up and dislodges stopper 162. More particularly, cone 336 of novel frac plug 330 comprises an assembly of a wedge 361 and stopper 162. Wedge 361 is substantially identical to wedge 161 of frac plug 130 except the middle cylindrical portion of its bore 363 is somewhat longer than bore 163 of wedge 161. The lower tapered shoulder provides a ball seat 367, and a ball 368 is captured in the chamber between the bottom face of stopper 162 and ball seat 367. If stopper 162 is dislodged from wedge 361, ball 368 can easily flow back into wedge 361 and seat on ball seat 367 when pressure above plug 330 is increased.

The body, cone, slips, and other components of the novel frac plugs may be fabricated from materials typically used in plugs of this type. Such materials may be relatively hard metals, but more typically would be relatively soft, or more brittle, more easily drilled metals, such as cast iron. They also may be fabricated from non-metallic materials commonly used in plugs, such as fiberglass and carbon fiber resinous composite materials. When composites are used, the body and cone may be molded, but more typically will be machined from wound fiber resin blanks, such as a wound fiberglass cylinder. Wound fiber resin blanks can be machined readily to provide the various elements and features of the plug components. Such materials will allow the plug to be drilled more easily once fracturing is completed.

Preferably, however, the body and cones of the novel frac plugs are made from dissolvable metals, that is, metals that will dissolve, soften, disintegrate, or otherwise break down wholly or partially in the presence of existing or controlled conditions in the well by any mechanism. Such dissolvable metals typically are magnesium or aluminum alloys that may be dissolved, for example, with a plug of an acid solution. Other dissolvable metals include metal matrices, such as magnesium-graphite and magnesium-calcium matrices. The dissolvable metal may also be coated with materials that provide complimentary a properties. Coatings may be used, for example, to protect the base metal prior to deployment of the plug, to strengthen it, or to control its rate of dissolution.

When the novel plugs or components thereof are made from dissolvable metal, they preferably are provided with one or more dissolution passages. For example, as noted above, when gauge ring 138 is fabricated from dissolvable metal it preferably is provided with dissolution passages 158. Dissolution passages 158 are through holes extending axially from the lower face of gage ring 138 to its upper face. They thus significantly increase the surface area of gage ring 138 that is exposed to fluids in the well. Other factors being equal, dissolution passages 158 allow gage ring 138 to weaken and disintegrate more rapidly.

It will be understood that dissolution passages 158 are provided solely to facilitate disintegration of gage ring 138 and are not adapted to contribute to any other significant function or aspect of gage ring 138 or frac plug 130. For example, the central opening extending through gage ring 138, while necessarily increasing its surface area, will not be understood as a dissolution passage since it also serves to accommodate the lower end of wedge 161. Similarly, bottomed passages accommodating set screws, gripping buttons, and the like will not be understood as dissolution passages.

It also will be understood that other components of frac plug 130 and other embodiments of the novel frac plugs may be provided with dissolution passages, either through holes or bottomed holes. For example, axially extending bottomed or through holes may be provided in slips 137, and bottomed holes may be provided in wedge 161 and stopper 162. Other dissolution holes, of varying geometry, may be suitable as well.

As readily appreciated by workers in the art, refinements in the basic design of the plug body will be dictated by the choice of materials. Metal being generally stronger, for example, the plug body may be made somewhat thinner and shorter when it is fabricated from metal instead of composites. In general, the taper angles for the body and cone will provide a self-locking taper fit. When fabricated from metal, a self-locking taper fit may be provided when the taper angle of the body and cone is from about 5° to about 30° off center or from about 10° to about 30° off center depending on the specific metal. If fabricated from composites, the taper angle generally will be more acute, for example, from about 1° to about 10°.

The choice of material also will determine in large part the geometry and other design criteria of the bridging portions joining the elements within preferred embodiments such as frac plug 30. Thus, the manner, stress points, and nature of the break in the bridging portions will vary somewhat. Depending on the material used and the direction of the break, the break may be a relatively clean, distinct severing of the elements. In other instances, the break may be more of a rough tear. The object is simply that the bridging portions break sufficiently to allow independent movement of the non-expanded and expandable portions of the slip. That may be accomplished by scoring, thinning, perforating the material or in other conventional ways.

Seal rings 35 and 135 of, respectively, plug 30 and plug 130 are fabricated from a sufficiently ductile material so as to allow the ring to deform plastically and expand radially into contact with a liner without breaking. For example, the seal ring may be fabricated from hard, elastomeric rubbers, such as butyl rubber. Alternately, seal rings may be fabricated from aluminum, bronze, brass, brass, copper, mild steel, or magnesium and magnesium alloys. The ring also may be fabricated from a plastic material. Plastic components are more easily drilled, and the resulting debris more easily circulated out of a well. Engineering plastics, that is, plastics having better thermal and mechanical properties than more commonly used plastics, are preferred. Engineering plastics that may be suitable for use include polycarbonates and Nylon 6, Nylon 66, and other polyamides, including fiber reinforced polyamides such as Reny polyamide. "Super" engineering plastics, such as polyether ether ketone (PEEK) and polyetherimides such as Ultem®, are especially preferred. Mixtures and copolymers of such plastics also may be suitable.

The seal rings also may be fabricated from dissolvable metals, elastomers, or engineering plastics, that is, materials that will dissolve, soften, disintegrate, or otherwise break down wholly or partially in the presence of existing or controlled conditions in the well by any mechanism. A dissolvable elastomer may be degraded, for example, by chemical or biological action. Dissolvable elastomers made be formed, for example, by elastomeric polymers carried in a dissolvable resin matrix.

Power charge 73 and the ignitor are generally of the type as used in conventional pyrotechnic setting tools. They are widely available in the market, for example, from Baker Hughes Company, Owen Oil Tools, and Diamondback Industries. The power charge tools, a pressure chamber subs, and ignitor tools may be modified as necessary to accommodate power charges and ignitors from different manufacturers, or adaptors may be devised to couple conventional power charge tools and ignitor tools to the novel plugs.

Power charges are a reliable and relatively inexpensive tool for generating gas and increasing fluid pressure, and more specifically gas pressure to actuate the novel plugs. If desired, however, other fluid pressure systems may be used. For example, a gas-over-hydraulic system may be devised wherein increasing gas pressure generated by a power charge acts on a plug of liquid above the cone of the novel frac plugs. Hydraulic pressure also may be applied to the cone via a hydraulic line. In other embodiments, mechanical force may be applied to the cone of the novel frac plugs. For example, conventional power-charge setting tools may be modified such that the push-drive component bears directly on the cone of the novel frac plugs. It will be appreciated, however, that such embodiments require additional components and do not provide the advantage of simplicity and economy provided by more preferred embodiments described in detail herein, such as the novel frac plug tool assemblies comprising power charge tools and the novel frac plugs.

It also will be appreciated that preferred embodiments of the frac plugs and frac plug assemblies of the subject invention have been described as comprising several specific components. Separate parts often facilitate fabrication and assembly. At the same time, however, they may be assembled from greater or fewer components. For example, slip 34 and pressure chamber sub 71 have been described as separate components. If desired, they may be an integral component and the description of them as being coupled together shall not be understood as disclaiming an integral slip/sub. On the other hand, for example, gauge ring 34*c* may be fabricated as a separate component.

As should be apparent from the foregoing discussion, references to "upper," "lower," "upward," "downward," and the like in describing the relative location or orientation of plug features are made contemplating an installed plug. Thus, an "upper" and "lower," and variants thereof, would be synonymous with, respectively, "uphole" and "downhole."

The various embodiments of the novel frac plugs also have been described as installed in a liner and, more specifically, a production liner used to fracture a well in a various zones along the wellbore. A "liner," however, can have a fairly specific meaning within the industry, as do "casing" and "tubing." In its narrow sense, a "casing" is generally considered to be a relatively large tubular conduit, usually greater than 4.5" in diameter, that extends into a well from the surface. A "liner" is generally considered to be a relatively large tubular conduit that does not extend from the surface of the well, and instead is supported within an existing casing or another liner. In essence, a "liner" is a "casing" that does not extend from the surface. "Tubing" refers to a smaller tubular conduit, usually less than 4.5" in diameter. The novel plugs, however, are not limited in their application to liners as that term may be understood in its narrow sense. They may be used to advantage in liners, casings, and perhaps even in smaller conduits or "tubulars" as are commonly employed in oil and gas wells. A reference to liners shall be understood in context as a reference to all such tubulars.

Likewise, while the exemplified plugs are particularly useful in fracturing a formation and have been exemplified in that context, they may be used advantageously in other processes for stimulating production from a well. For example, an aqueous acid such as hydrochloric acid may be injected into a formation to clean up the formation and ultimately increase the flow of hydrocarbons into a well. In other cases, "stimulation" wells may be drilled in the vicinity of a "production" well. Water or other fluids then would be injected into the formation through the stimulation wells to drive hydrocarbons toward the production well. The novel plugs may be used in all such stimulation processes where it may be desirable to create and control fluid flow in defined zones through a well bore. Though fracturing a well bore is a common and important stimulation process, the novel plugs are not limited thereto.

Pump-Down Sleeve 80

As noted above, preferred tool assemblies comprising the novel frac plugs also comprise pump-down sleeve 80. Pump-down sleeve 80, for example, couples frac plug 130 to pressure chamber sub 171 of a power charge tool. As its name implies, pump-down sleeve 80 also assists in deploying frac plug 130 into and through liner 10.

Pump-down sleeve 80 has a generally cylindrical geometry. As best appreciated from FIG. 6, however, its outer surface is profiled to provide a series of, for example, five annular ribs 81 extending radially from a nominal outer circumference of pump-down sleeve 81. Each annular rib 81 extends around pump-down sleeve 80. As may be seen for example in FIG. 7, ribs 81 have a generally triangular cross-section (as taken along a plane extending across the primary axis of the sleeve).

The triangular cross-section provides each rib 81 with an upper annular surface 82 and a lower annular surface 83. The width of lower annular surface 83, in each rib 81, is greater than the width of upper annular surface 82. As appreciated by careful inspection, it also will be appreciated that the height or radial peak of each rib 81 successively increases from the uppermost rib 81*a* to the lowermost rib 81*e*.

Novel pump-down sleeve 80 significantly increases the efficiency of deploying the novel frac plug 130 into liner 10. For example, when frac plug 130 is deployed as part of a wireline tool assembly, such as tool string 20, it can be deployed relatively efficiently in vertical portion 1*v* of well 1 given that the tool string will tend to fall through line 10 under the influence of gravity. Fluid must be pumped into liner 10, however, to transport the tool string through the horizontal portion 1*b* of well 1.

For example, in a typical pump-down operation, fluid may be pumped into liner 10 at the rate of 20-21 barrels/minute (bbl/min), thus creating a flow of about 800 feet/minute (ft/min) through liner 10. Because of drag and other factors, however, the tool string will be transported at much lower speeds. Consider tool string 20 for example. As shown in FIG. 3, it includes the assembly of novel frac plug 30 and pressure chamber sub 71. That assembly has a relatively uniform diameter that is substantially the same as the maximum diameter of frac plug 30. Such tool strings may be transported through liner 10 at an average speed of from about 350 to 400 ft/min. It has been observed, however, that when novel pump-down sleeve 80 is used with novel plug 130, deployment speeds of from about 450 to about 500 ft/min may be obtained at the same pump rates.

It will be appreciated that the cumulative effect of reducing the time it takes to deploy an individual frac plug is even more significant. Frac jobs require significant manpower and a vast array of pumps and other equipment. The number of stages or intervals fractured can be quite large and typically increase with the length of the horizontal portion. Wells commonly are fractured in at least about 20 to about 50 stages. Wells with longer laterals may involve over a hundred stages. The novel pump-down sleeves thus can reduce significantly equipment and manpower costs. Alternatively, lower pump rates may be used to provide equivalent deployment speeds, and fluid costs may be significantly reduced.

It will be appreciated that because upper annular surfaces 82 are narrower and steeper than their corresponding lower annular surfaces 83, annular ribs create zones in which fluid pressure increases rapidly followed by zones in which fluid pressure decreases relatively slowly. That is, because fluid flows down and around pump-down sleeve 80 as the tool string is deployed, upper annular surfaces 82 provide leading edges. As fluid flows over upper annular surface 82 fluid pressure around pump-down sleeve 80 increases rapidly. Lower annular surfaces 83 provide trailing edges, allowing pressure to drop, but more slowly as compared to the pressure rise. Moreover, because the height of each rib 81 successively increases from the uppermost rib 81*a* to the lowermost rib 81*e*, the maximum pressure rise around pump-down sleeve 80 does not occur until fluid approaches the lowermost portion of pump-down sleeve 80 that is connected to frac plug 130.

While not wishing to be bound by any particular theory, it is believed that the alternating high-pressure and low-pressure zones created by ribs 81 reduce drag around frac plug 130. Thus, it is expected that ribs 81 may have cross-sections other than the triangular cross-section illustrated herein. Other geometries, such as curved surfaces, effective to produce alternating high and low-pressure zones should provide comparable reductions in drag. Similarly, it is expected that the novel pump-down sleeves may be used to advantage in combination with other frac plugs and other types of downhole tools, especially those that, like the novel frac plugs, necessarily are deployed into a liner with fairly close tolerances and that experience significant drag as they are pumped into a well.

Finally, it will be appreciated that the same profiled outer surface of pump-down sleeve 80 that assists in deploying frac plug 130 into liner 10 may hinder pull-out of the tool string. By minimizing drag as it is pumped into the liner, pump-down sleeve 80 will increase the drag of the remaining tools in the tool string once the power charge tool is separated from frac plug 130 and are pulled out of the liner. Thus, pump-down sleeve 80 is provided with ports, such as twelve ports 84 radially arrayed just below lowermost rib 81*e*. Ports 84 allow fluid to flow from the exterior of the tool string into the interior of pump-down sleeve 80 as the tool string is pulled out of the liner.

While this invention has been disclosed and discussed primarily in terms of specific embodiments thereof, it is not intended to be limited thereto. Other modifications and embodiments will be apparent to the worker in the art.

What is claimed is:

1. A frac plug adapted for setting in a well liner, said frac plug comprising:

(a) a radially expandable body having an axial bore, said bore providing said expandable body with a tapered inner surface, said tapered inner surface decreasing in diameter from the upper extent of said tapered inner surface toward the lower extent of said tapered inner surface;

(b) a cone occluding said axial bore of said expandable body and adapted to radially expand said expandable body, said cone:

i) having a tapered outer surface engaging said expandable body tapered inner surface, said tapered outer surface decreasing in diameter from the upper extent of said tapered outer surface toward the lower extent of said tapered outer surface, said cone tapered outer surface and said expandable body tapered inner surface having complimentary angles; and ii) being adapted for displacement axially from an unset position to a set position;

(c) whereby said cone, in response to fluid pressure within said frac plug, is displaced axially from said unset position to said set position, thereby radially expanding said expandable body.

2. The frac plug of claim 1, wherein said frac plug comprises a radially expandable sealing ring around an outer circumference of said expandable body.

3. The frac plug of claim 1, wherein said expandable body and said cone are fabricated from a dissolvable metal.

4. The frac plug of claim 1, wherein:

(a) said expandable body tapered inner surface is a generally inverted truncated conical surface; and (b) said cone tapered outer surface is a generally inverted truncated conical surface.

5. The frac plug of claim 1, wherein said tapered outer surface of said cone and said tapered inner surface of said expandable body are provided with a taper from about 5° to about 30° off center.

6. The frac plug of claim 1, wherein said tapered outer surface of said cone and said tapered inner surface of said expandable body provide a self-locking taper fit between said cone and said expandable body.

7. The frac plug of claim 1, wherein said frac plug comprises a pressure seal carried between said cone and said axial bore of said expandable body.

8. The frac plug of claim 1, wherein:

(a) said expandable body comprises an upper, non-expanded portion and a lower, expandable portion; and (b) said tapered inner surface of said expandable body is provided in said expandable portion.

9. The frac plug of claim 8, wherein said non-expanded portion and said expandable portion of said expandable body are joined by a relatively weak bridging portion adapted to break in a controlled manner, said separable non-expanded portion and expandable portion thereby forming an integral component comprising said non-expanded portion and said expandable portion.

10. The frac plug of claim 1, wherein said cone comprises:

(a) a wedge, said wedge providing said cone with said tapered outer surface and having an axial bore; and (b) a stopper occluding said axial bore of said wedge whereby said cone occludes said axial bore of said expandable body.

11. The frac plug of claim 10, wherein said cone is fabricated from a dissolvable metal and comprises at least one dissolution passage.

12. The frac plug of claim 10, wherein said stopper, when said frac plug is set in said liner, is adapted to be displaced from said wedge by fluid pressure below said frac plug and thereby allow fluid flow upward through said frac plug.

13. The frac plug of claim 12, wherein, after said stopper is displaced upward from said wedge, said frac plug comprises means for guiding said stopper back into said wedge, thereby shutting off fluid flow downward through said frac plug.

14. The frac plug of claim 13, wherein said frac plug comprises:

(a) a traveler mounted for movement though a pair of opposing, axially extending lateral slots is said wedge; and (b) a connecting rod extending between said stopper and said traveler.

15. The frac plug of claim 13, wherein said frac plug comprises a ball and ball seat provided in said axial bore of said wedge below said stopper, wherein said ball is captured between said stopper and said ball seat.

16. The frac plug of claim 10, wherein:

(a) said expandable body comprises an upper, non-expanded portion and a lower, expandable portion; and (b) said tapered inner surface of said expandable body is provided in said expandable portion.

17. The frac plug of claim 16, wherein said frac plug comprises:

(a) an elastomer sealing ring mounted around said expandable portion of said expandable body; and (b) an array of slips having tapered inner surfaces and mounted around and on a lower portion of said tapered outer surface of said wedge of said cone; and (c) wherein a lower end of said expandable portion of said expandable body engages an upper end of said array of slips.

18. The frac plug of claim 17, wherein:

(a) said frac plug comprises a gage ring coupled to a lower end of said cone; and (b) a lower end of said array of slips abuts said gage ring.

19. The frac plug of claim 18, wherein said gage ring is fabricated from a dissolvable metal and comprises at least one dissolution passage.

20. The frac plug of claim 16, wherein, when said frac plug is in its said unset state, said cone is mounted in said expandable body such that an upper portion of said tapered outer surface on said wedge of said cone engages said tapered inner surface of said expandable portion of said expandable body.

21. The frac plug of claim 10, wherein said frac plug comprises an annular array of slips having tapered inner surfaces, wherein:

(a) said slips are mounted around and on a lower portion of said tapered outer surface of said wedge of said cone;

(b) said slip tapered inner surfaces and said wedge tapered outer surface have complementary angles; and (c) said slips are adapted to be shifted radially outward into engagement with said liner as said cone is displaced axially from its said unset position to its said set position.

22. The frac plug of claim 21, wherein said slips are fabricated from a dissolvable metal and comprises at least one dissolution passage.

23. The frac plug of claim 1, wherein said cone is a stopper occluding said axial bore of said expandable body.

24. The frac plug of claim 23, wherein:

(a) said expandable body comprises an upper, non-expanded portion and a lower, expandable portion; and (b) said tapered inner surface of said expandable body is provided in said expandable portion.

25. The frac plug of claim 24, wherein said expandable portion of said expandable body provides a radially expandable slip adapted to expand radially into engagement with said liner as said stopper is displaced axially from its said unset position to its said set position.

26. An oil and gas well comprising a liner, wherein the frac plug of claim 1 has been installed by driving said cone into said expandable body by fluid pressure applied to an upper surface of said cone.

27. A tool assembly for occluding a well liner, said tool assembly comprising:

(a) a frac plug adapted for setting in said liner, said frac plug comprising:

i) a radially expandable body having an axial bore, said bore providing said expandable body with a tapered inner surface, said tapered inner surface decreasing in diameter from the upper extent of said tapered inner surface toward the lower extent of said tapered inner surface;

ii) a cone occluding said axial bore of said expandable body and adapted to radially expand said expandable body, said cone:

(1) having a tapered outer surface engaging said expandable body tapered inner surface, said tapered outer surface decreasing in diameter from the upper extent of said tapered outer surface toward the lower extent of said tapered outer surface, said cone tapered outer surface and said slip tapered inner surface having complimentary angles; and (2) being adapted for displacement axially from an unset position to a set position;

(b) a fluid pressure generator operably coupled to said frac plug and in fluid communication with an upper surface of said cone;

(c) whereby said cone, in response to fluid pressure generated by said fluid pressure generator, moves from said unset position to said set position, thereby expanding said slip radially into engagement with said liner.

28. The tool assembly of claim 27, wherein said fluid pressure generator generates gas pressure.

29. The tool assembly of claim 27, wherein said fluid pressure generator comprises a pressure chamber sub that is integral with said expandable body.

30. The tool assembly of claim 27, wherein:

(a) said expandable body comprises an upper, non-expanded portion and a lower, expandable portion; and (b) said tapered inner surface of said expandable body is provided in said expandable portion.

31. The tool assembly of claim 30, wherein said fluid pressure generator comprises a generally cylindrical pressure chamber sub assembled to said non-expanded portion of said expandable body.

32. The tool assembly of claim 27, wherein said fluid pressure generator comprises a generally cylindrical pressure chamber sub and a combustible power charge carried within said pressure chamber sub and adapted to generate gas pressure therein.

33. The tool assembly of claim 32, wherein said tool assembly comprises an ignitor operatively coupled to said combustible power charge.

* * * * *